United States Patent [19]

Okada et al.

[11] Patent Number: 5,027,160

[45] Date of Patent: Jun. 25, 1991

[54] IMAGE FIXING APPARATUS WITH MOVABLE FILM AND MEANS FOR CONTROLLING FILM POSITION

[75] Inventors: Tamotsu Okada; Atsushi Hosoi, both of Kawasaki; Yoshihiko Suzuki, Tokyo; Kanji Yano, Kawasaki, all of Japan

[73] Assignee: Canon Kabushiki Kaisha, Tokyo, Japan

[21] Appl. No.: 446,449

[22] Filed: Dec. 5, 1989

[30] Foreign Application Priority Data

| | | | |
|---|---|---|---|
| Dec. 8, 1988 | [JP] | Japan | 63-159721[U] |
| Dec. 12, 1988 | [JP] | Japan | 63-313275 |
| Dec. 12, 1988 | [JP] | Japan | 63-313278 |
| Dec. 22, 1988 | [JP] | Japan | 63-325561 |
| Mar. 31, 1989 | [JP] | Japan | 64-80376 |

[51] Int. Cl.[5] ..... G03G 15/20

[52] U.S. Cl. ..... 355/282

[58] Field of Search ..... 355/284, 282, 285, 286, 355/289, 290; 219/216, 388; 432/59, 60

[56] References Cited

U.S. PATENT DOCUMENTS

| | | | |
|---|---|---|---|
| 3,578,797 | 5/1971 | Hodges | 263/3 |
| 3,810,735 | 5/1974 | Moser | 219/216 X |
| 3,811,828 | 5/1974 | Ohta et al. | 219/216 X |
| 4,566,779 | 1/1986 | Coli et al. . | |
| 4,780,742 | 10/1988 | Takahashi et al. | 219/216 X |

*Primary Examiner*—R. L. Moses

*Attorney, Agent, or Firm*—Fitzpatrick, Cella, Harper & Scinto

[57] ABSTRACT

An image fixing apparatus includes a heater; an endless film through which a toner image on a recording material is heated by heat produced by the heater; and a controller for controlling a position of the endless film in a direction perpendicular to a rotating directon of the endless film.

72 Claims, 21 Drawing Sheets

IMAGE FIXING APPARATUS WITH MOVABLE FILM AND MEANS FOR CONTROLLING FILM POSITION

FIELD OF THE INVENTION AND RELATED ART

The present invention relates to an image fixing apparatus for heating and fixing a toner image on a recording material, usable with an image forming apparatus such as an electrophotographic machine or an electrostatic recording machine.

In a widely used conventional image fixing apparatus used with an image forming apparatus wherein a toner image is formed on a recording material, the recording material supporting an unfixed toner image is passed through a nip formed between a heating roller maintained at a predetermined temperature and a pressing or back-up roller having an elastic layer and press-contacted to the heating roller. The conventional image fixing system of this type requires that the heating roller is always maintained at an optimum temperature, so that the thermal capacity of the heating roller has to be large to prevent the temperature variation. Therefore, the time period required for the warming of the apparatus is long, and in addition, the power consumption is large.

In order to avoid this problem, U.S. Pat. No. 3,578,797 proposes an image fixing apparatus wherein the toner image is fused by heat from a heating roller through an endless belt.

U.S. Ser. No. 206,767 which has been assigned to the assignee of this application proposes a novel image fixing apparatus wherein the use is made with a thin endless film and a fixed heater having a low thermal capacity, by which the warming period is significantly reduced or eliminated.

Since, however, the image fixing system using the endless belt as disclosed in the U.S. Patent or the U.S. Application, imparts driving force or tension by a roller or rollers to constitute an endless travel path, the belt or the film is laterally deviated or shifted (in a direction perpendicular to the movement of the endless belt).

In order to solve this problem, it is considered that the number of the rollers is increased to reduce the intervals between the rollers, or that the precision of the constituents part is increased, by which the lateral shift of the film is suppressed to a certain extent. However, they would result in increase of the cost, and in the inability of mass-production.

When the lateral shift of the endless belt occurs, and when it increases, the tension applied to the endless belt becomes non-uniform, or the heater and the toner are directly contacted, so that the toner off-set is produced, or that the image is disturbed.

SUMMARY OF THE INVENTION

Accordingly, it is a principal object of the present invention to provide an image fixing apparatus using an endless film and capable of performing stabilized image fixing operation for a long period of time.

It is another object of the present invention to provide an image fixing apparatus wherein lateral shift of an endless belt is controlled.

It is a further object of the present invention to provide an image fixing apparatus wherein local wearing of an endless film by a recording material is prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
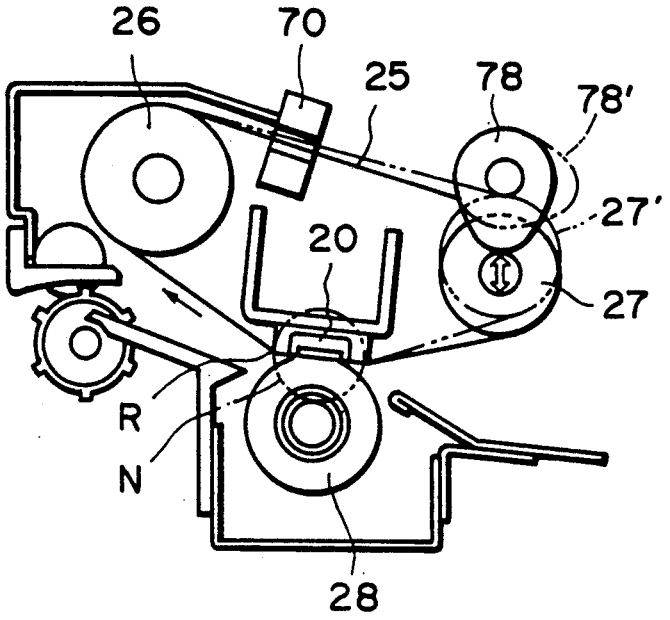
FIGS. 1 and 2 are sectional views of image fixing apparatuses according to embodiments of the present invention.

The embodiments of the present invention will be described in conjunction with the accompanying drawings, wherein like reference numerals are assigned to the elements having the corresponding functions.

Referring to FIG. 1, there is shown a sectional view of an image fixing apparatus according to an embodiment of the present invention. The image fixing apparatus comprises a heater 20 having a low thermal capacity and fixed in the fixing apparatus and an image fixing film 25 in the form of an endless belt contacted to the heater 20 and movable in the direction indicated by an arrow. A driving roller 26 and a follower roller 26 in part driving force and tension to the fixing film 25 and constitutes a path of the film movement. A pressing roller includes a rubber elastic layer having a good releasing property, made of silicone rubber or the like, and rotates while pressing the fixing film 25 to the heater 20.

The recording material (not shown) carrying thereon an unfixed toner image is introduced into a fixing position (nip) N, where the unfixed image is fixed.

Adjacent to a lateral end of the fixing film 25, there is provided a detecting element 70 such as a photosensor to detect the lateral position of the film. In response to the detection signal, control means controls an eccentric cam 78, as indicated by the chain line 78', so as to displace one longitudinal end of a follower roller, as indicated by a chain line 27' to control the lateral position of the fixing film. More particularly, when the fixing film 25 starts to shift in one direction to such an extent that the detecting element 70 detects it, the follower roller 27 is displaced at one end or inclined to apply to the fixing film 25 force in the opposite direction. By doing so, the fixing film 25 is driven while its lateral position is maintained with a predetermined range (in the region between the detecting elements 70 at the both sides in this embodiment). By this control, the shift of the fixing film 25 can be controlled without changing the heating conditions in the fixing position N.

Figure 2:
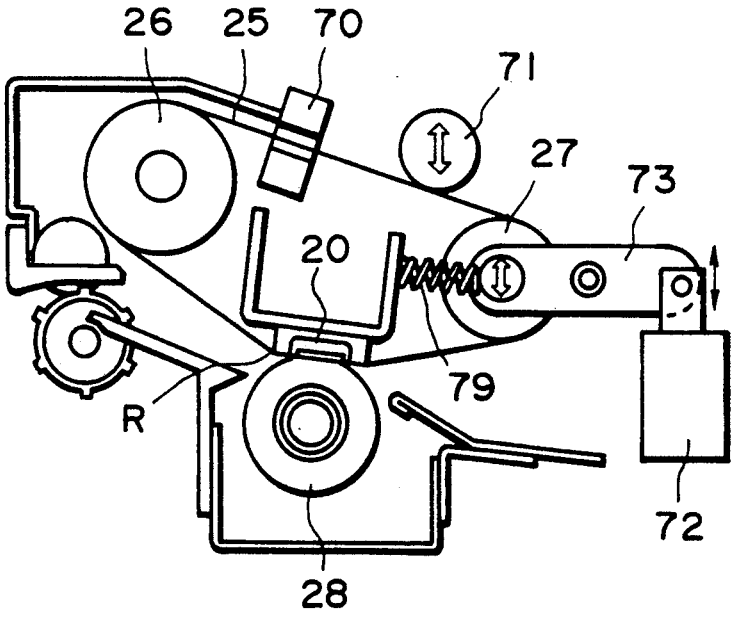

In this embodiment, the follower roller 27 is displaced by an eccentric cam 78 substantially vertical direction. However, the direction of the displacement is not limited to this. However, as compared with the case of displacing it in substantially horizontally, the substantially vertical movement is preferable for the following reasons. As shown in FIG. 2, the follower roller 27 receives the tension force by the tension spring 79 in order to drive the fixing film 25 without crease, and in addition, the fixing position N is heated, and therefore, larger displacing force is required in order to displace it substantially in the direction which is the same as the direction of the tension force, and the fixing film 25 can be elongated or creased by the sheet.

The roller to be displaced is not limited to the follower roller 27, but it is possible to displace the driving roller 26 to control the shift of the fixing film 25. However, if the driving roller is displaced, the driving means has to include additional mechanism such as swinging mechanism, and therefore, the cost may be increased.

In addition, the roller to be shifted is desirable upstream of the fixing position N. This is because at the downstream side of the fixing position N, the recording material discharged from the fixing position N has to be separated from the fixing film 25, and therefore, if the roller is displaced downstream of the fixing position N, particularly adjacent to the separating position, the separation action at the separating position S may be influenced in the separation angle and the precise separating position. If the shifting force is applied extremely at the separating position S, the separating conditions can be changed by the crease of the film, with the result that the improper separation, jam or the toner off-set to the fixing film 25 easily occur. Therefore, the position of the displaceable roller is preferably upstream of the fixing position N and downstream of the driving roller 26, with the driving roller 26 stationary.

Referring to FIG. 2, an image fixing apparatus according to another embodiment will be described. In this embodiment, a separate member 71 which is displaceable is used to control the lateral shift.

By displacing the tension member 71, the shift of the film 25 is controlled. FIG. 2 also shows another method of displacing the displaceable roller, by a solenoid 72 via lever 73. The detector 70 may include a lever or levers disposed close to the lateral end or ends of the fixing film 25 to detect the position of the film.

The amount and timing of the displacement are selected in accordance with various conditions of the respective members. The detecting position, the number of detecting positions and the displacing conditions may be determined in accordance with the size of the apparatus.

According to this embodiment, the stabilized driving of the fixing film is accomplished without influence to the fixing position.

Figure 3:
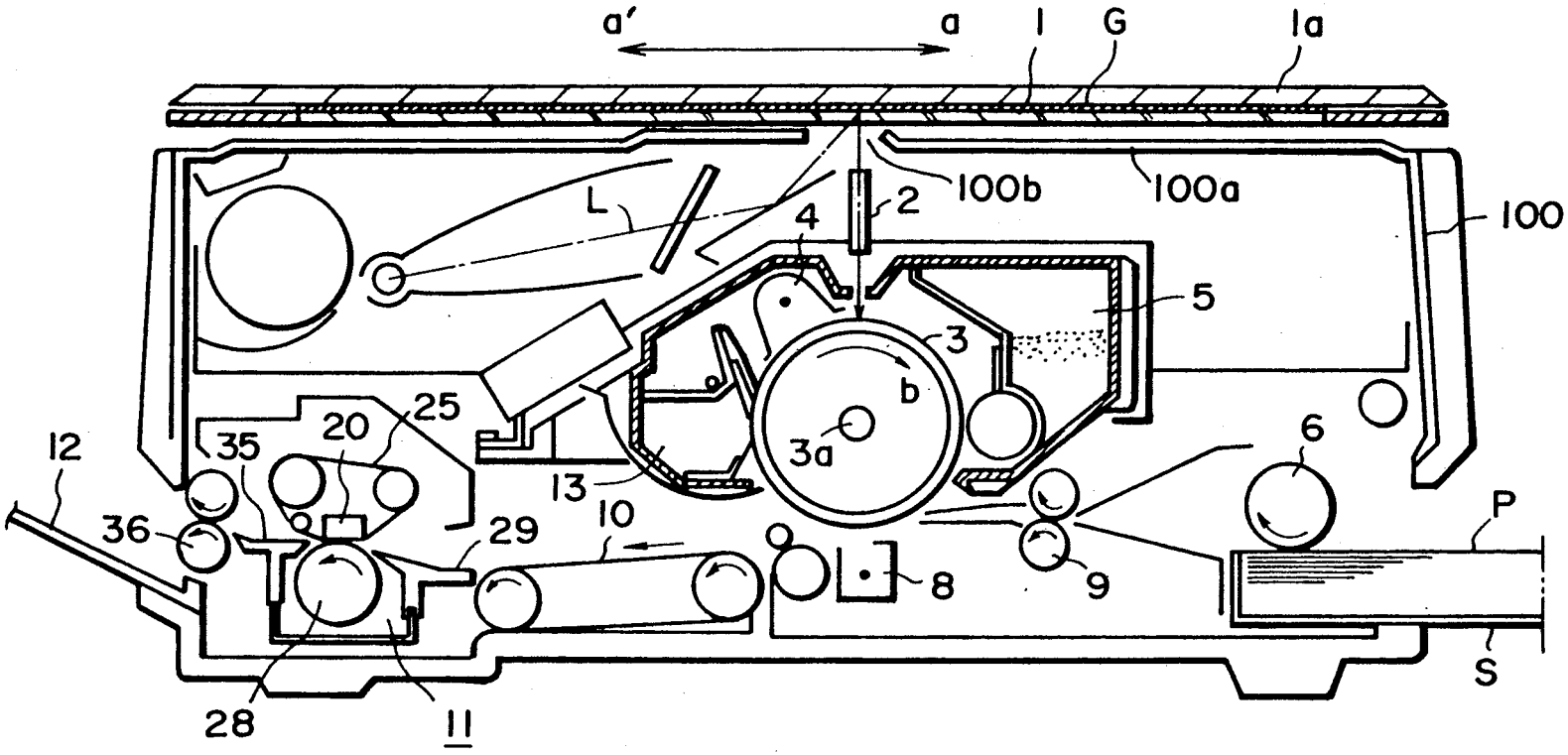
FIG. 3 is a sectional view of an example of image forming apparatus using the image fixing apparatus according to an embodiment of the present invention.

Referring to FIG. 3, a further embodiment will be described. FIG. 3 is a sectional view of an exemplary image forming apparatus provided with an image heating and fixing apparatus 11 according to an embodiment of the present invention. Image forming apparatus in this embodiment is an electrophotographic copying machine wherein an original supporting platen is reciprocable, and which includes a rotatable drum and which is of an image transfer type.

As shown in FIG. 3, the image forming apparatus comprises a casing 100, an original supporting platen 1 of a reciprocable type including a transparent member made of glass plate or the like on a top plate **100*a* of the casing 100, wherein the original supporting platen is reciprocable on the top plate 100*a*** in the rightward direction a and in the leftward direction a' at the predetermined speeds.

Designated by a reference G is an original to be copied, it is placed face-down on the top surface of the original supporting platen at a predetermined original reference position and is covered by an original pressing plate **1*a***.

A slit opening **100*b* is formed in the top plate 100*a*, extending in a direction perpendicular to the reciprocal direction of the original supporting platen 1 (perpendicular to the sheet of the drawing). The image surface of the original G on the original supporting platen 1 passes gradually by the slit opening 100*b* from its right side during the rightward stroke a of the reciprocable movement. During the passage, the original is scanned by light L from a lamp 7 through a slit opening 100*b* and through the original transparent original supporting platen 1. The light reflected by the scanning illumination light is formed on a surface of a photosensitive drum 3 through an array 2** of short focus and small diameter imaging elements.

The photosensitive drum 3 has a coated photosensitive layer made of a photosensitive material such as zinc oxide or organic photoconductor, and is rotatable in the clockwise direction b at a predetermined speed about a central shaft **3*a*. During the rotation, it is uniformly charged to a positive or negative polarity by a charger 4. The surface having been uniformly charged is exposed to the light image of the original (slit exposure), so that an electrostatic latent image is formed on the photosensitive drum 3**.

The electrostatic latent image is developed by a developing device 5 into a visualized image with toner made of resin which is softened or fused by heating and other material or materials. The toner image (visualized image) is advanced to an image transfer station having an image transfer discharger 8.

The transfer material sheet P (recording material) are accommodated in a cassette S. From the cassette, the sheets are fed out one-by-one by a pick-up roller 6. The sheet P is then fed to the transfer discharger 8 by the registration roller 9 in such a timed relation that when the leading edge of the toner image on the drum reaches the transfer discharger 8, the leading edge of the transfer material sheet P reaches the transfer discharger 8 so that they are aligned. Then, the toner image is transferred from the photosensitive drum 3 onto the fed sheet by the transfer discharger 8.

The sheet having received the toner image is separated from the photosensitive drum 3 by an unshown separating means, and is conveyed to a fixing device 11 by a conveying device 10. In the fixing device 11, which will be described in detail hereinafter, in the unfixed toner image is heated and fixed, and finally, it is discharged onto the discharge tray 12 through a guide 35 and discharging rollers 36.

Figure 4:
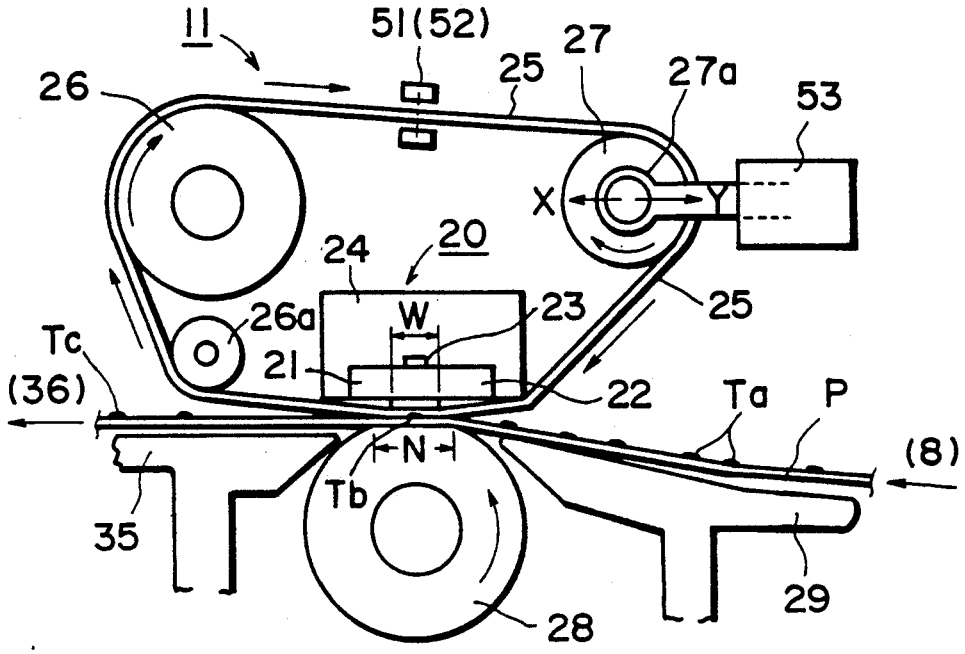
FIG. 4 is a sectional view of an image fixing apparatus according to another embodiment of the present invention.

The surface of the photosensitive drum 3, after the toner image is transferred is cleaned by a cleaning device 13, by which the residual toner remaining on the photosensitive drum and the contamination are removed, so that it is prepared for the next image forming operation. FIG. 4 is an enlarged view of the fixing apparatus 11.

An endless fixing film 25 is stretched around a left side driving roller 26, a right side follower roller 27, a low thermal capacity linear heater 20 fixed at a lower position between the rollers 26 and 27 and a guide roller **26*a* disposed below the driving roller 26, the rollers 26 and 27, the heater 20 and the guiding roller 26*a*** being extended parallel to each other.

The follower roller 27 functions as a tension roller for applying tension to the endless fixing film 25. When the driving roller 26 rotates in the clockwise direction, the fixing film 25 is rotationally driven without crease, snaking movement and delay, at a peripheral speed which is substantially the same as the transfer sheet P having thereon the unfixed toner image Ta supplied from the image forming station 8.

A pressing roller 28 functioning as a member for urging the sheet has a rubber elastic layer having a good releasing property, made of silicone rubber or the like. It presses the bottom travel of the endless fixing film 25 to the bottom surface of the heater 20, by an unshown urging means, with the total pressure of 4–7 kg. It rotates in the same peripheral direction as the transfer sheet P, that is, in the counterclockwise direction.

Since the endless fixing film 25 is repeatedly used for the heat-fixing the toner image, it is good in the heat resistivity, the releasing property and the durability. Generally, it has a thickness of not more than 100 microns, preferably not more than 50 microns. It is a single layer film made of heat-resistive resin such as polyimide, polyetherimide, PES or PFA (copolymer of tetrafluoroethylene and perfluoroalkyl vinyl ether) or a compound layer film including a film having a thickness of 20 microns and a releasing coating layer of 10 microns, at least at the image contacting side of the film, including fluorinated resin such as PTFE (tetrafluoroethylene resin) or PFA resin and a conductive material added thereto.

A heater supporting member 24 is heat-resistive, and provides the entire mechanical strength of the heater 20. It is made of a highly heat-resistive resin such as PTS (polyphenylene sulfide), PAI (polyamide imide), PI (polyimide), PEEK (polyester ester ketone) or liquid crystal polymer or a compound material including such a resin and ceramic material or glass.

A base plate 21 for the heater is, for example, alumina base plate having a thickness of 1.0 mm, a width of 10 mm and a length of 240 mm. A heat generating element is in the form of a line or stripe having a low thermal capacity, for example. It has, for example, a width of 1.0 mm and is extended along the length of the base plate 21 substantially at the middle thereof. It is made of, for example, $Ta_2N$ or other elastic resistance material which generates heat upon electric energization. A temperature detecting element 23, for example, is a low thermal capacity temperature measuring resistor such as Pt film applied by screen printing or the like along the length substantially at the center of the top surface (opposite from the surface having the heat generating element 22) of the base plate 21.

In this embodiment, the linear or stripe heat generating element 22 is supplied with electric power by the electric connections at the longitudinal ends to generate heat along the entire length of the heat generating element 22. The energization is performed through an energization control circuit so that DC 100 V pulses are applied at the period of 20 msec with the pulse width being changed in accordance with the temperature detected by the temperature detecting element 23.

The pulse width is controlled within the range of 0.5–5 msec, and the heat generating element 22 is instantaneously heated up to 200°–300 ° C. each time the pulse is applied. In this embodiment, there is a sensor (not shown) for sensing the leading and trailing edges of the sheet adjacent to the fixing device at its upstream side with respect to the transfer sheet conveyance direction. Using the detection signal by the sensor, the energization period for the heat generating element 22 is limited to the period in which the sheet P is passing through the fixing device 11.

An operation of the apparatus of this embodiment will be described. Upon image formation start signal, the image forming apparatus formed an image and feeds the sheet from the transfer station 8 to the fixing device 11. When the leading edge of the sheet P having the unfixed toner image Ta on its top surface is detected by the sensor (not shown) disposed adjacent to the fixing device, the fixing film 25 starts to rotate or travel. The transfer sheet P is guided along the guide 29, and is introduced into the nip N (fixing nip) between the fixing sheet 25 and the pressing roller 28, by which the toner carrying side of the sheet P is closely contacted to the bottom surface of the fixing film moving at the same speed at the sheet P, and they are passed together through the nip without surface deviation or crease.

The heat generating element 22 has a width W which is within the fixing nip N formed between the bottom surface of the heater 20 and the pressing roller 28.

The image carrying surface of the sheet P is heated from the heat generating element 22 through the fixing film 24 while it is passed through the nip N while being in press-contacted to the fixing film surface, and the toner image is fused at the high temperature, and it is softened or bonded on the sheet P as a softened or bonded toner image Tb.

In this embodiment, the separation between the sheet P (the recording material) and the fixing film 24 is effected after the sheet P has passed through the fixing nip N.

At the separating position, the temperature of the toner Tb is higher than the glass transition point, and therefore, the bonding force between the sheet P and the fixing film 25 is small at the separation point, and therefore, the sheet P is always smoothly separated with hardly any toner off-set to the fixing film 25 and without the sheet P sticks to the fixing film 25 and without the resulting jamming.

The toner Tb at the temperature higher than the glass transition point has proper rubber characteristics so that the toner image at the separating point does not follow the surface of the fixing film, and therefore, it has a sufficiently rough surface property. Then, the toner is cooled and solidified without changing the surface property. Therefore, the toner image fixed is not glossy, and has a high quality.

The sheet P separated from the fixing film 25 is guided by the guide 35 and is conveyed to the couple of discharging rollers 36. During the conveyance, the temperature of the toner Tb decreases from the temperature higher than the glass transition point by spontaneous cooling, and is solidified into a solidified toner image Tc. The sheet P thus having the fixed toner image is discharged to the tray 12.

In this embodiment, the linear heat generating element 22 of the heater 20 is instantaneously heated upon energization to a sufficiently high temperature in consideration of the toner fusing point (or fixable temperature), and therefore, it is not necessary to keep the heat generating element energized during the stand-by state of the apparatus. Therefore, only little heat is transferred to the pressing roller 28 when the fixing operation is not carried out. During the fixing operation, in the fixing nip N between the heater 20 and the pressing roller 28, the fixing film, the toner image and the sheet P are disposed, and the heating period is short. For those reasons, there exists a steep temperature gradient. Therefore, the pressing roller 28 is not easily heated, and therefore, the temperature thereof is maintained lower than the toner fusing point even when a practically continuous image forming operation is performed.

In the apparatus of this embodiment, the toner image made of the heat fusible toner on the sheet P is first heated and fused by the heater 20 through the fixing film, and particularly, the surface layer of the toner is completely softened and fused. At this time, the heater, the fixing film, the toner image and the sheet are urged by the pressing roller 28, so that the heat is efficiently transferred. By this, the toner image can be efficiently heated and fused with minimum heating of the sheet P itself. In addition, the energization period is limited. For those reasons, the energy consumption can be saved.

The size of the heater may be small, and therefore, the thermal capacity may be small. Therefore, it is not necessary to pre-energize the heater increasing the stand-by period. The power consumption during the non-fixing-operation can be reduced, and in addition, the temperature rise within the apparatus can be prevented.

The description will now be made as to the control for the lateral shift of the fixing film, that is the deviation in the direction perpendicular to the movement direction of the fixing film.

Figure 5:
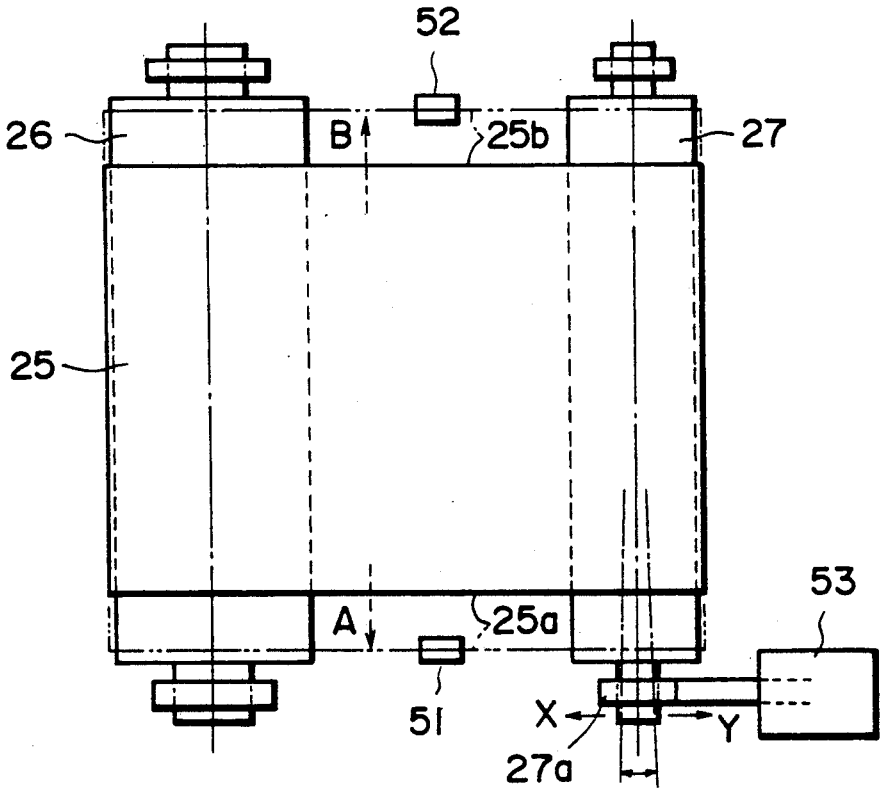
FIG. 5 is a top plan view of the image fixing apparatus of FIG. 4.

As shown in FIGS. 4 and 5, first and second film position detecting means 51 and 52 are disposed at a front and rear side of the fixing film, namely, bottom side and top side in FIG. 5. They are, for example, photointerruptors photoreflectors or the like.

The film 25 is stretched around the driving roller 26, the follower roller 27, the heater 20 and the guide roller 26*a*. When the entirety of the fixing film 25 shifts toward the front side (A), and the amount of shifts exceeds a tolerance, the front side edge 25*a* of the film is detected by the first film position detecting means 51, and the event is transmitted to the control circuit. On the contrary, if the film 25 shifts toward the rear side beyond the tolerance (B), the rear edge 25*b* of the film 25 is detected by the second film position detecting means 52, and the event is transmitted to the control circuit.

A control mechanism 53 for controlling the shift of the fixing film 25 is associated with a bearing 27*a* at the front side of the follower roller 27 and functions to horizontally displace it toward (X) and away (Y) from the driving roller 26.

Generally, a belt-like member tends to shift toward a side where a distance between shafts around which the belt is stretched is smaller. The control mechanism utilizes this tendency. When the bearing 27*a* of the follower roller 27 at the front side is moved toward (X) the driving roller 26, the fixing film 25 shifts entirely toward the front side (A). On the contrary, if it is moved away (Y) from the driving roller 26, the fixing film 25 moves entirely toward the rear side (B).

When the film detection signal is produced from the first film position detecting means 51, the shift controlling mechanism moves the bearing 27*a* of the follower roller 27 toward the front side (Y), so that the front shift of the fixing film 25 is corrected. When the film detection signal is transmitted to the control circuit from the second film position detecting means 52, the bearing 27*a* is moved in the direction X, by which the rear shift of the fixing film 25 is corrected.

Figure 6:
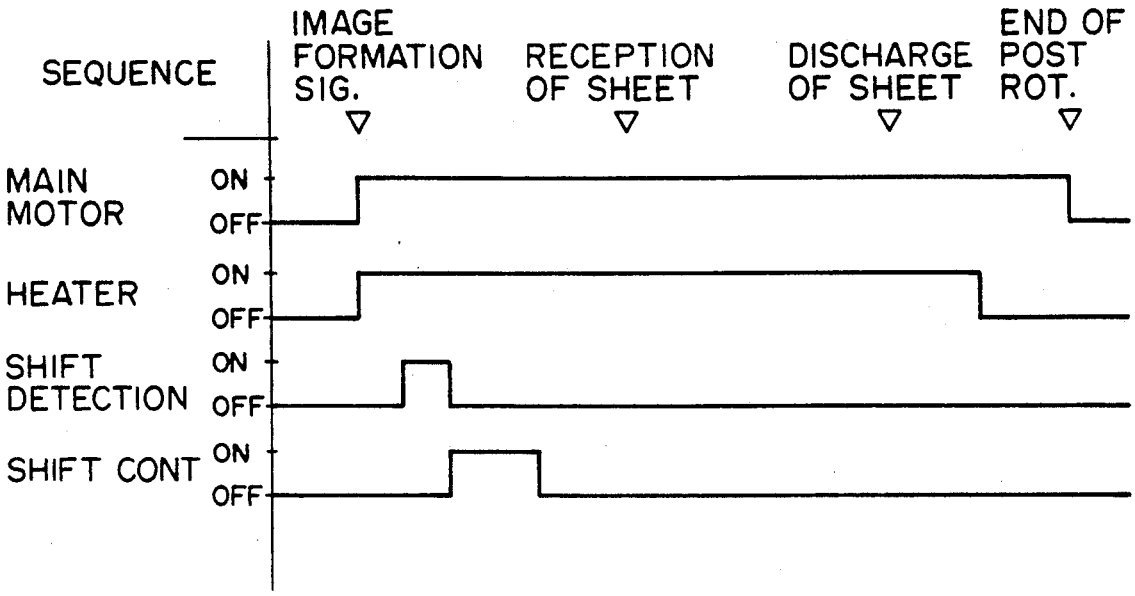
FIG. 6 is a timing chart of a film shift control.
Figure 7:
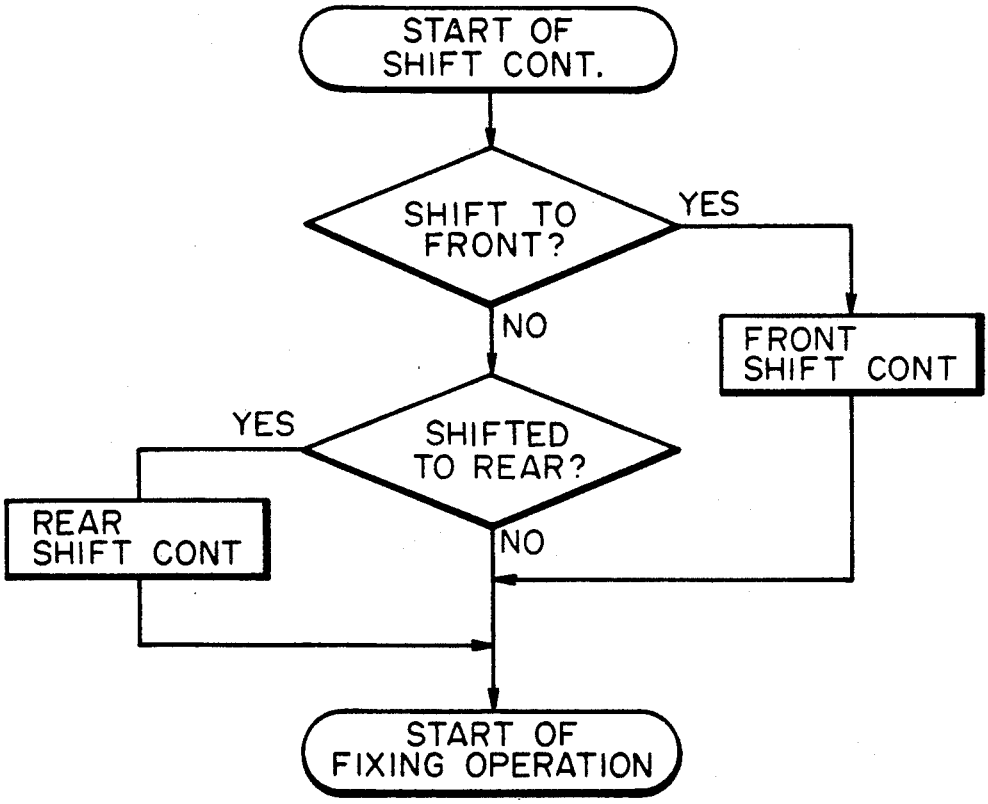
FIG. 7 is a flow chart for the sequential control.

FIGS. 6 and 7 are a timing chart and a control sequence of the film 25 shift control. When the image formation signal is produced, the main motor starts to rotate, and simultaneously therewith or after a certain delay, the driving roller 26 is driven, and the heater 20 (22) is energized and controlled. After the start of the main motor, the first and second position detecting means 51 and 52 detect the shift of the fixing film 25, and if the shift beyond the tolerance is detected, the mechanism 53 immediately controls the fixing film 25 in response to the detection signal.

After the completion of the control, the transfer sheet P is introduced into the fixing apparatus 11, and the fixing operation is carried out.

Since the shift control is completed before the transfer sheet P is introduced into the fixing apparatus 11, the vibration of the fixing film resulting from the shift control does not influence the transfer sheet P, and since the fixing film 25 is positioned in place before the fixing operation starts, good images can be obtained.

If the fixing film 25 is at the correct position, the shift control is not performed, and the fixing operation is directly started. With the above control is performed, the fixing film 25 is maintained at correct position during the fixing operations, and therefore, a good fixed image can be provided, and simultaneously, the production of crease or the like of fixing film attributable to the lateral shift of the fixing film 25, is prevented.

In the foregoing embodiment, the shift control operation is performed during a pre-rotation period of an image formation cycle, that is, during the period in which the fixing operation is not performed, and the recording material is not passed through the fixing apparatus. It may be performed during a post-rotation period after the image formation.

Figure 8:
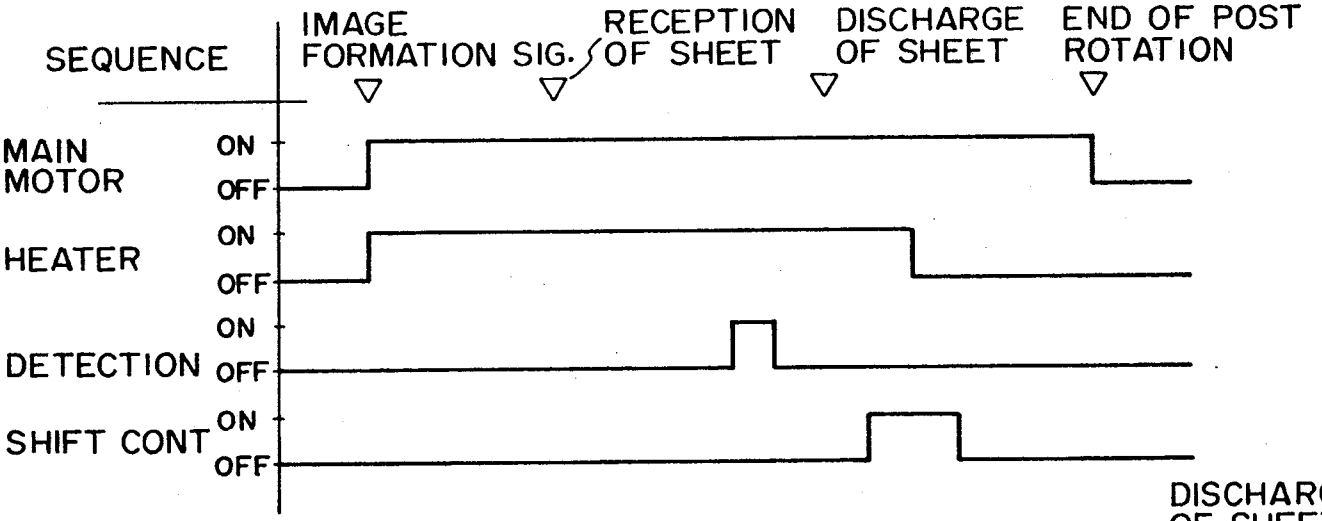
FIGS. 8, 9 and 10 are timing charts of other examples.

FIG. 8 shows a timing chart in that case. Where the shift control is performed during the post-rotation, the time period for the pre-rotation can be shortened, and therefore, the time required for the first image formation can be reduced.

When a plurality of images are to be formed, the shift control may be performed between adjacent fixing operations, that is, during the interval between the succeeding sheets.

Figure 9:
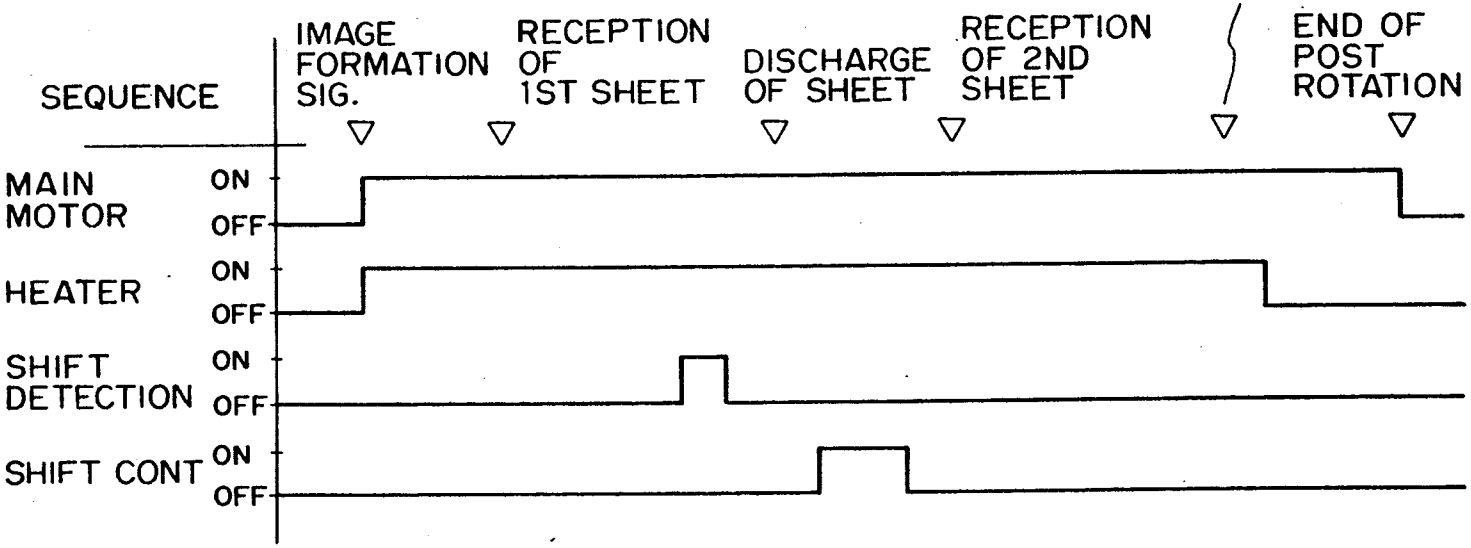

FIG. 9 is a timing chart in that case. By performing the shift control during the interval between the sheets, the fixing film shift control is more frequently performed than when it is performed during the pre-rotation period or the post-rotation period, and therefore, the amount of the shifts of the fixing film 25 can be suppressed more, and therefore, it is preferable.

Figure 10:
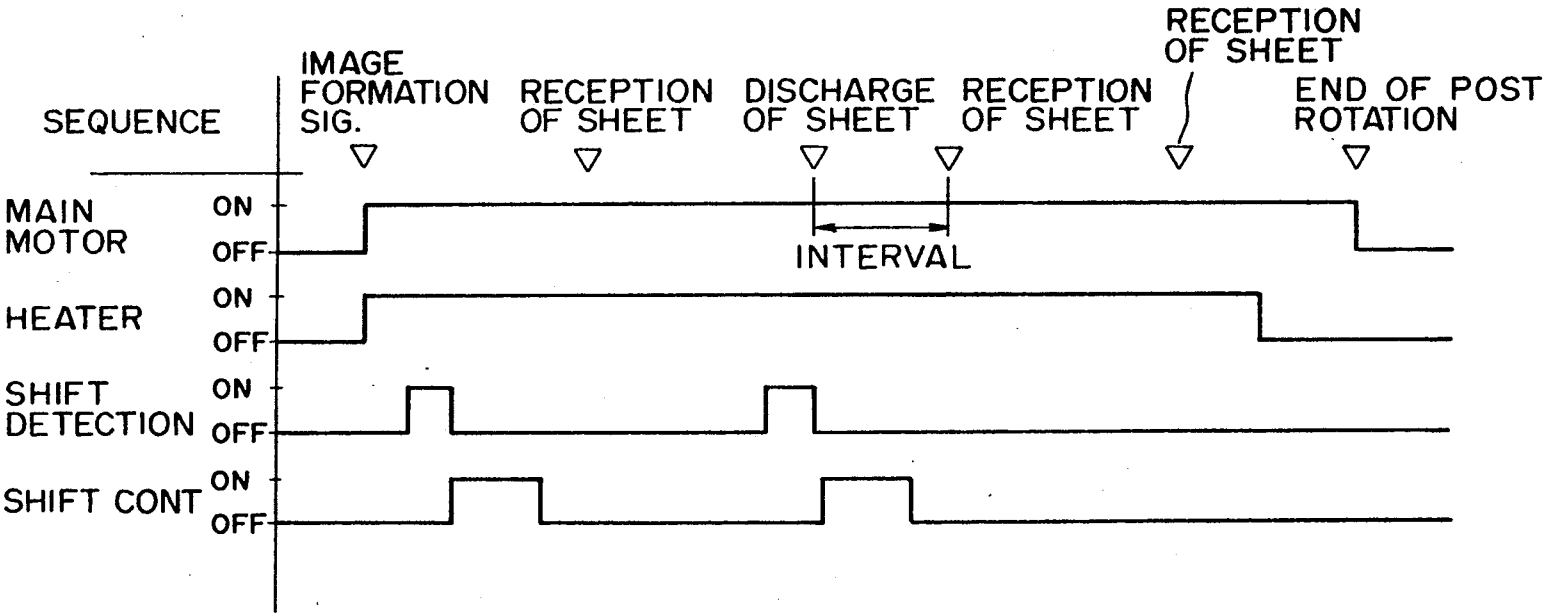

FIG. 10 shows a timing chart, in which the pre-rotation shift control and the interval shift control are combined, or in which the interval shift control and the post-rotation shift control are combined. By such a combination, the amount of shift can be suppressed during a single image formation mode or during a plural image formation mode, and therefore, it is preferable.

In the foregoing embodiment, the shift control mechanism 53 is effective to change the distance between the shafts at one side. But it may be in the form of an mechanism for moving the follower roller 27 in a skewed position.

The point of time for detecting the shift may be during the passage of the sheet or during the non-passage of the sheet, but it is preferably carried out immediately before the lateral shift control.

The material of the base plate 21 of heater 20 may be, in addition to the alumina, a heat-resistive glass or heat-resistive resin such as PI or PPS. The material of the heat generating element 22 may be, in addition to $Ta_2N$, nichrome, $RuO_2$, Ag/Pd or another resistor. The temperature detecting element 23 may be made of a bead thermister having the low thermal capacity in place of the temperature detecting resistor such as Pt film. The bottom surface of the heater with which the fixing film 25 is in sliding contact is preferably provided with a protection layer such as a heat-resistive glass layer for protection from the sliding movement. The heat generating element 22 may be disposed on the top surface of the base plate, opposite from the film contacting side of the base plate 21, whereas the temperature detecting element 23 may be disposed at the bottom side of the base plate 21 (opposite from the fixing film contacting side). Further, both of the heat generating element and the temperature detecting element 23 are disposed on the bottom side of the base plate 21. The energization of the heat generating element 22 may be in a usual AC voltage form, in place of the pulse energization.

A felt pad may be provided to clean the film surface and to apply a slight amount of a parting agent such as silicone oil by impregnating the pad with the oil, by which the surface of the film is maintained clean and maintain in good parting property. Where the fixing film treated with insulating fuorine resin, electric charge easily produced on the film, the electric charge disturbing the toner image. In that case, the fixing film may be rubbed with a discharging brush which is electrically grounded to discharge the film. On the contrary, the film may be electrically charged by applying a bias voltage to such a brush without grounding it as long as the toner image is not disturbed it is a possible measure against the image disturbance due to the electric charge to add carbon black or the like in the fixing film. The same means is applicable against the electric charge of the backup roller. As a further alternative, antielectrification agent may be applied or added. The fixing film may be in the form of a cartridge detachably mountable to a predetermined position of the fixing device 11 to facilitate the exchange or the like of the fixing film.

The fixing device of this invention is not limited to an image transfer type electrophotographic copying apparatus, but is applicable to a type wherein a toner image is directly formed and carried on the electrofax sheet or an electrostatic recording sheet or the like, wherein the image is formed and recorded magnetically, or wherein an image is formed with a heat fusible toner on a recording medium by another image forming process and means. An example of such apparatus are heat fixing type copying machine, laser beam printer, facilimile machine, microfilm reader-printer, display device and recording device. The present invention is applicable to them.

As described in this embodiment, the lateral shift control of the fixing film is performed during the non-fixing-operation, by which the image is not smeared, or the sheet is not inclined even if the shift control is a high speed control, so that the time required for the shift control can be reduced.

Figure 11:
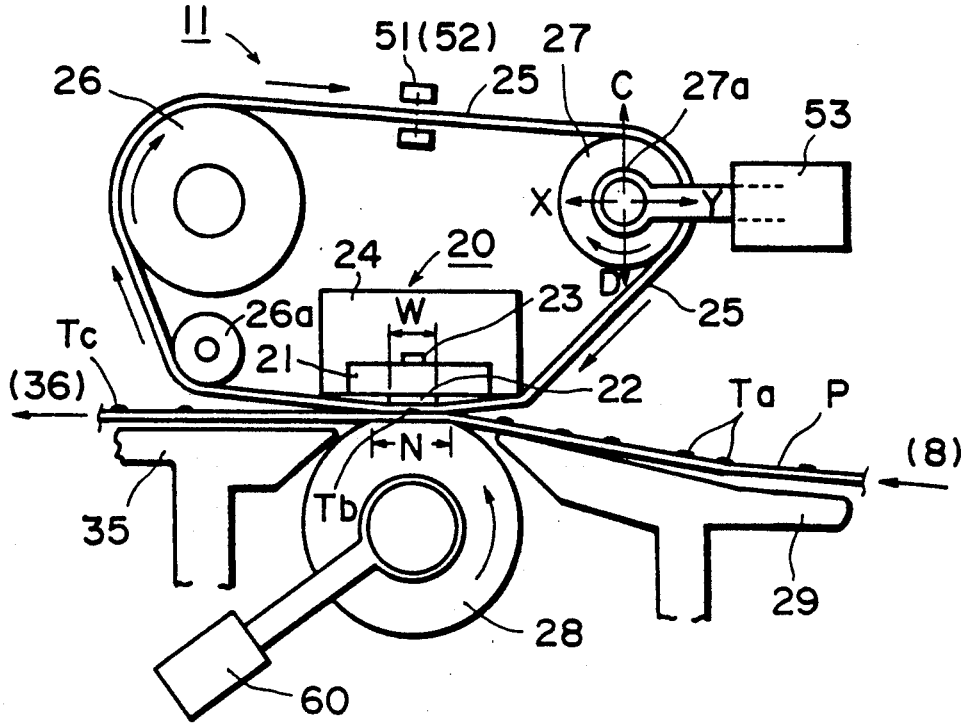
FIG. 11 is a sectional view of an image fixing apparatus according to another embodiment of the present invention.
Figure 12:
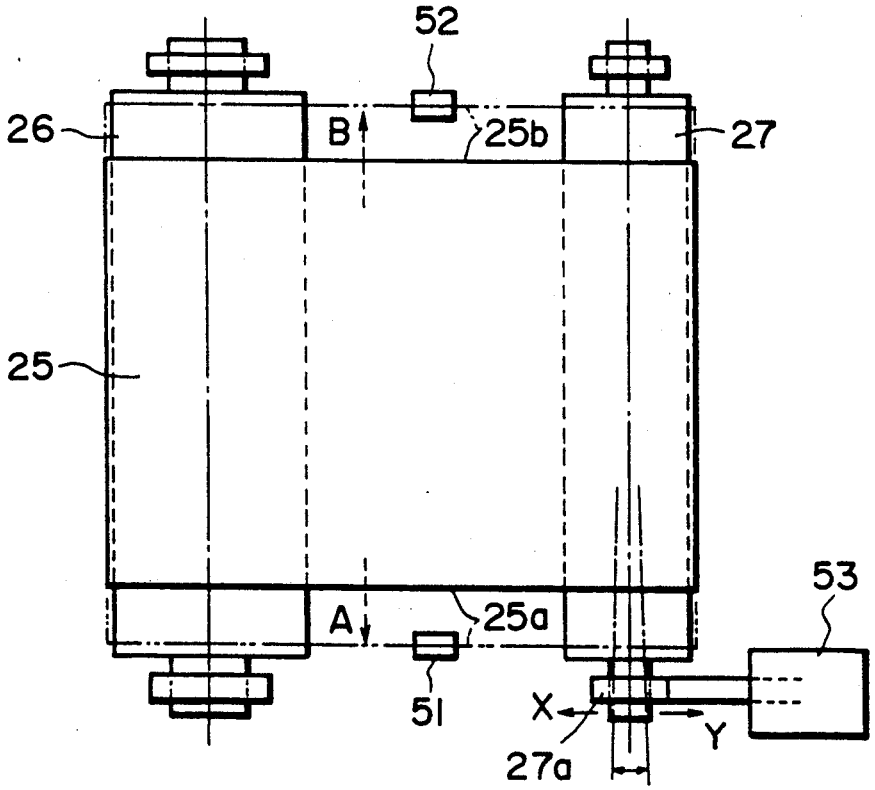
FIG. 12 is a top plan view of the image fixing apparatus of FIG. 11.

Referring to FIGS. 11 and 12, an image fixing apparatus of a further embodiment will be described. FIG. 11 is a sectional view, and FIG. 12 is a top plan view. The apparatus of this embodiment is provided with, in addition to the means of FIGS. 4 and 5 embodiment, a pressure releasing mechanism 60 for removing or reducing the pressure applied between the heater 20 and the pressing roller 28 through the fixing film 25. The pressure releasing mechanism 60 is operated in accordance with a control signal. When the mechanism does not operate, the pressing roller 28 is pressed toward the heater 20 with strong pressing force required for the image fixing action by an unshown urging means. The pressure releasing mechanism 60 is effective to remove or reduce the pressure by moving the pressing roller 28 away from the heater 20 against the urging means. The mechanism 60 includes an electromagnetic solenoid or the like.

Figure 13:
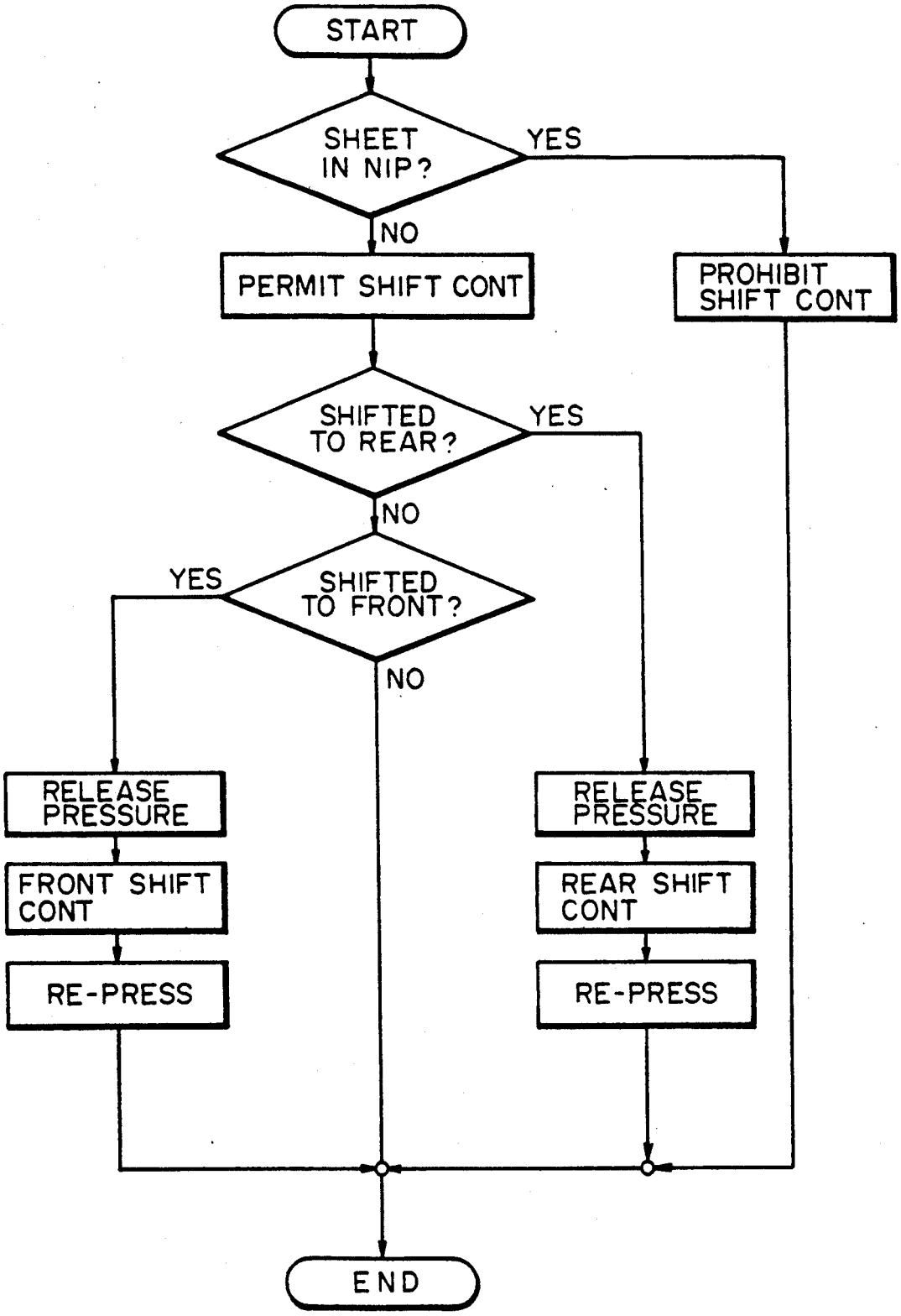
FIGS. 13 and 14 are flow charts for the sequential film shift control.

FIG. 13 shows a sequential flow chart for the lateral shift control in this case. In the image forming apparatus, the pre-rotation period, the sheet interval period and the post-rotation period in the image formation cycle are detected by an unshown sheet feed sensor, sheet discharge sensor or the like. Only during such periods, the prohibition of the lateral shift control is disabled to permit the lateral shift control of the fixing film. The prohibition of the control may be performed by soft means such as a microcomputer or by a hard mechanism.

When the shift control starts, and when the shift of the film is detected, the pressure by the pressing roller 28 is released, and thereafter, the shift control is effected, then, the pressure is applied again. Subsequently, the image forming process or the image formation stopping process is started.

By the control in this manner, good images can be provided, and the damage to the fixing film can be reduced, and therefore, the fixing apparatus or the image forming apparatus is significantly improved in the service life thereof.

In this embodiment, the pressure is removed or reduced only after the untolerable shift of the fixing film 25 is detected, the pressure is removed or reduced. However, it is a possible alternative that after the absence of the sheet P in the fixing nip N is detected, the pressure is immediately removed or reduced, and thereafter, the shift control is performed.

By immediately releasing the pressure, the period in which the fixing film 25 is pressed to the heater 20 is reduced, by which the amount of wearing of the fixing film and the heater 20 can be reduced, so that the service lives thereof are increased.

In this embodiment, the temperature control of the heater 20 is continued to perform when the pressure is reduced or removed. However, when the film is a thin film, the energization of the heater 20 may preferably be stopped in order to prevent the thermal damage to the film.

Figure 14:
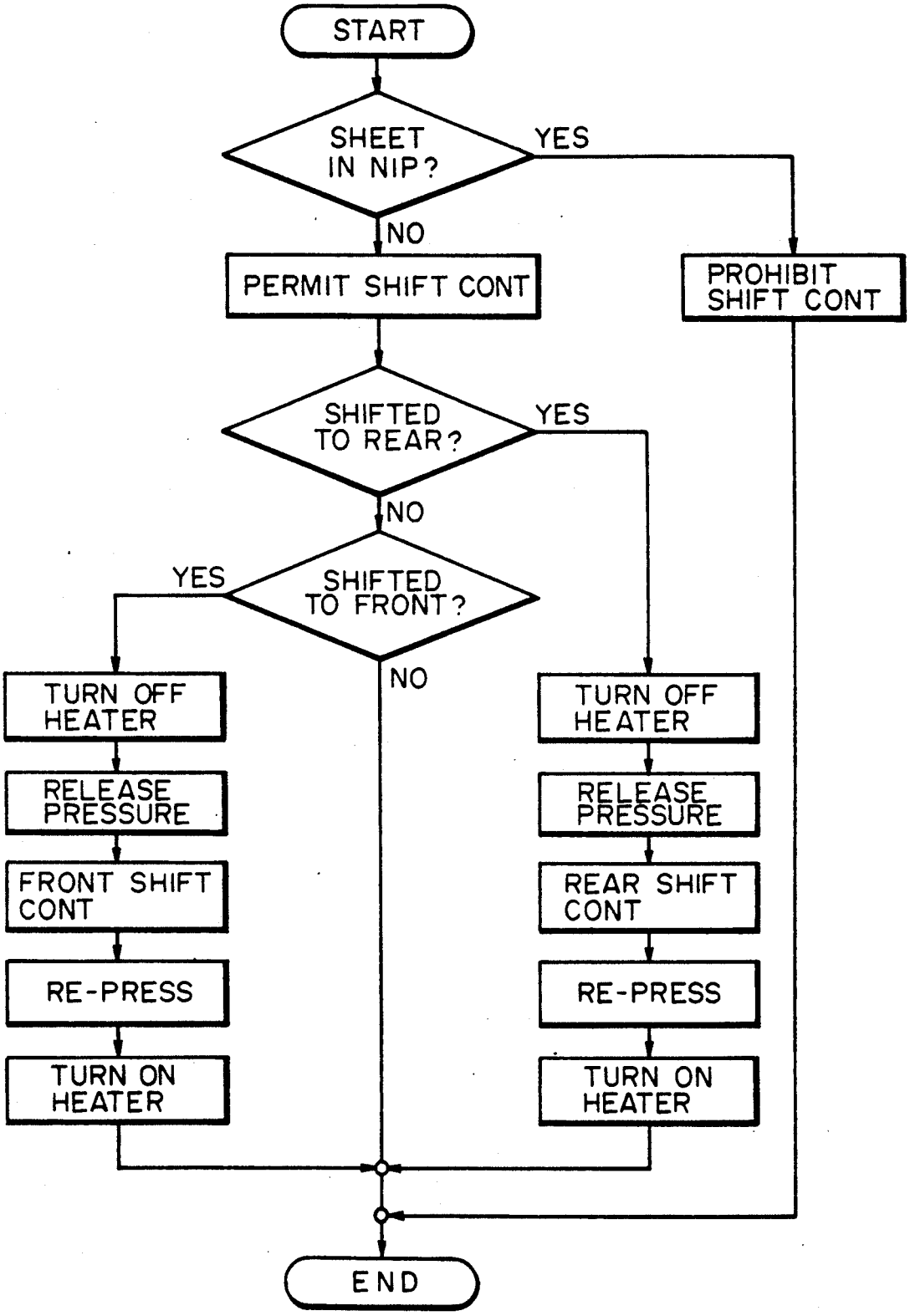

FIG. 14 is a sequential flow chart in that case. After the shift is detected, the energization of the heater 20 is stopped prior to the release of the pressure. Then, the pressure is released; the lateral shift is controlled; the pressure is applied again; and the heater 20 is re-energized.

In addition, by stopping the energization of the heater 20 prior to the removal or reduction of the pressure, the possible overheating of the heater 20 which is attributable to the change in the heat radiation characteristics of the heater 20 due to the separation of the pressing member 28 by the pressure release, is prevented. Therefore, it is preferable.

Figure 15:
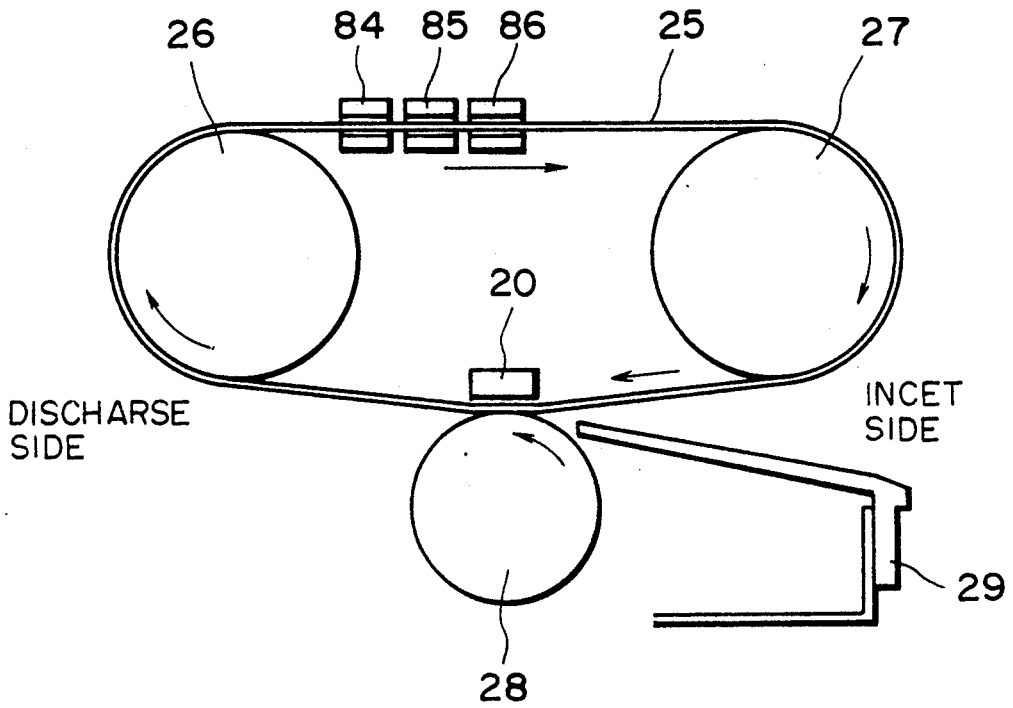
FIG. 15 is an enlarged view of an image fixing apparatus according to another embodiment of the present invention.
Figure 16:
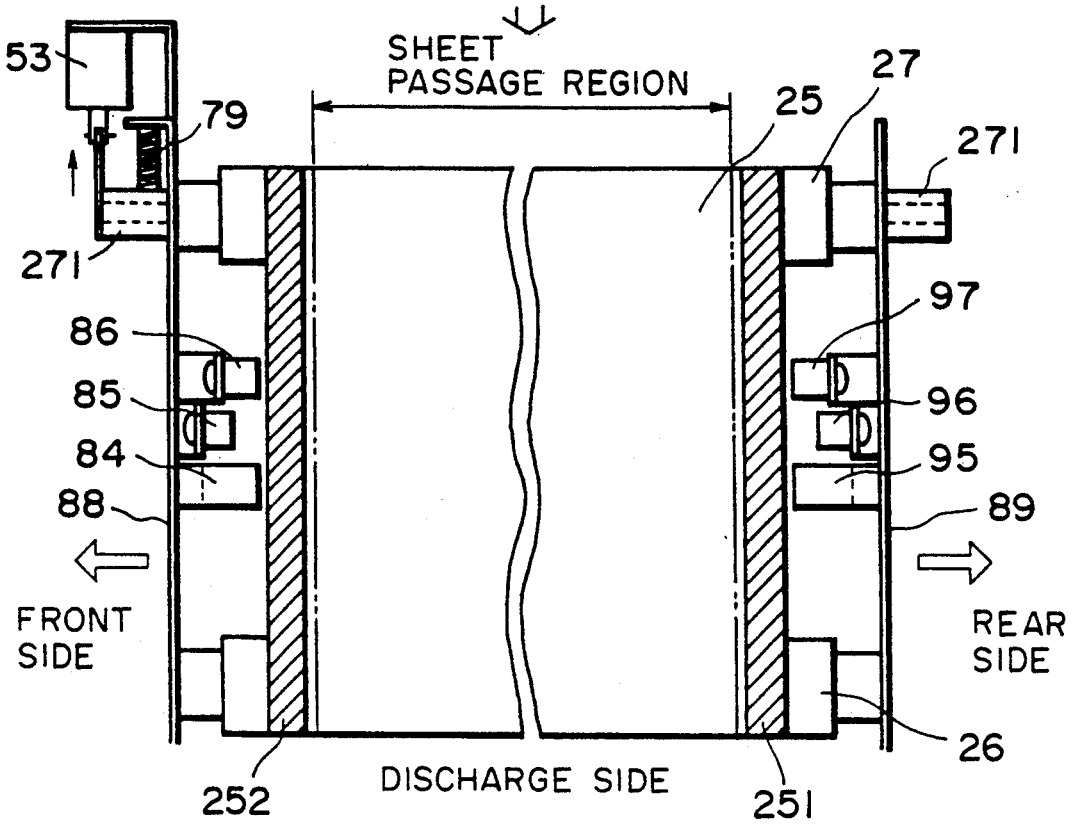
FIG. 16 is a top plan view of the image fixing apparatus of FIG. 15.

Referring to FIGS. 15 and 16, are further embodiment of the present invention will be described, which are an enlarged sectional view and an enlarged top plan view of the fixing apparatus of this embodiment. The follower roller 27 has bearings 271 and 272 at the opposite longitudinal ends thereof. The bearing 272 is abutted to a side plate by a compression spring 71*a*. With this structure, the error in the parallelism among the driving roller 26, the follower roller 27, the heater 20 and the pressing roller 28 (in the X-axis, Y-axis and Z-axis directions) are required to be zero. Otherwise, with the continuation of the driving of the driving roller 26 to move the film in the direction indicated by an arrow, the film 25 laterally shifts toward the front side or the rear side from the initial position shown in FIG. 16 due to the parallelism error among the three rollers and the heater (in X-axis, Y-axis and Z-axis directions), even to such an extent that either lateral end of the film comes to be rubbed with either of the side plates 88 and 89. To obviate this problem, the apparatus of this embodiment comprises a solenoid 53 associated with the bearing 272 to change the position or inclination of the follower roller 27. The mechanism is such that when the solenoid 53 is not energized, the film 25 shifts toward the front side in FIG. 16, whereas when the solenoid 53 is actuated, it is shifted toward the rear side. Photosensors 86, 97, 85 and 96 function to detect the position of the film 25. The sensors 85 and 96 are disposed outside the sensors 86 and 97.

As shown in FIG. 16, the front and rear edge portions 251 and 252 of the film 25 are treated to provide masks for interrupting the light of the photosensor. In this embodiment, the photosensor is type of a photointerruptor. If it is of a reflection type photosensor, the edge portions 251 and 252 of the film 25 are to be treated for reflecting light. In this embodiment, the masking treatment is effected only to the edge portions, but it may be applied on the entirety of the surface.

Figure 17:
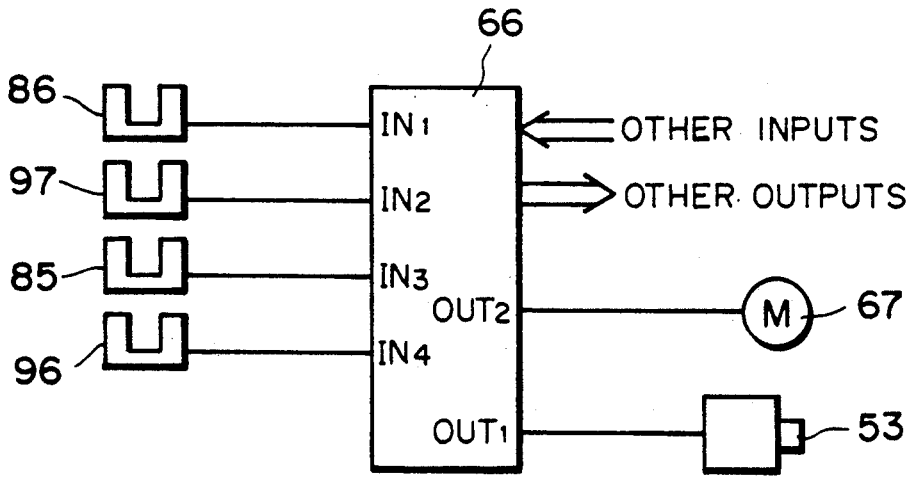
FIG. 17 schematically shows an electric control used in this embodiment.

Designated by reference numerals 84 and 95 are cleaning members for cleaning edge portions of the film. The edge portions of the film is always cleaned so as to prevent erroneous reading by a reflection type sensor or the like when the end portions are contaminated. In this embodiment, the cleaning means includes felt, but it may be of another material if it can clean the edge portions. FIG. 17 shows schematically an electric control circuit. A microcomputer 66 has input ports IN1, IN2, IN3 and IN4 connected to the photosensors 86, 97, 85 and 96. It also includes an output port OUT1 connected with a solenoid 53. An output port OUT2 produces a control signal for a motor which also drives the fixing apparatus of this embodiment. Although not shown, the microcomputer 66 is provided with input ports and output ports for input and output signals for the control of the copying apparatus using the fixing apparatus of this embodiment. The microcomputer 66 contains a ROM and a RAM having programs for the control of the copying operation.

Figure 18:
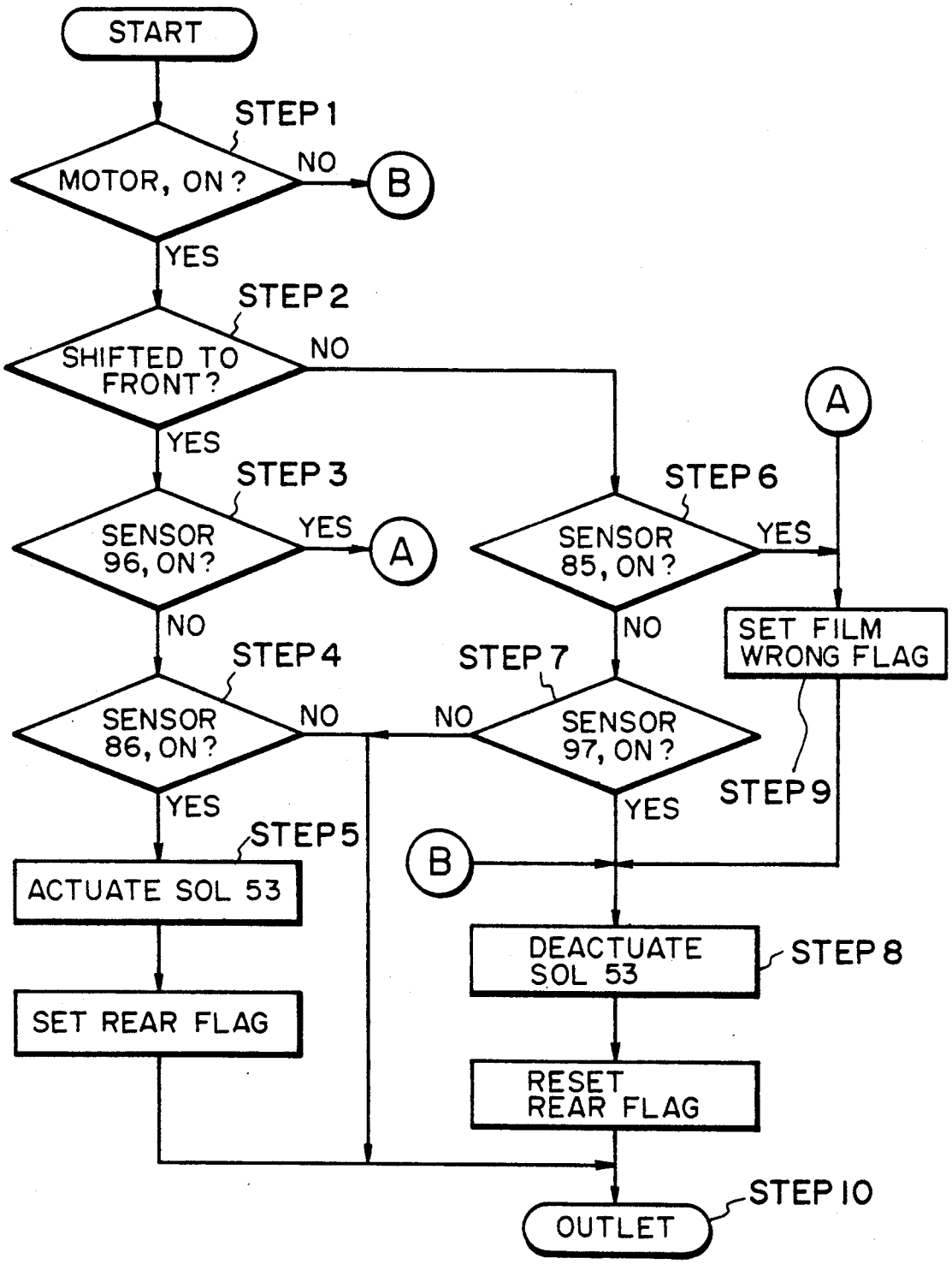
FIGS. 18 and 19 are flow charts of the control system.

FIG. 18 is a flow chart for the film shift control program, which is contained in the ROM in the microprocessor 66. The program is accessed upon necessity or a regular intervals by a main sequential control program or the like to perform the shift control operation.

After the start, the discrimination is made as to whether not the motor 67 is actuated, at step 1, if so, the step 2 is executed. If not, the shift control is not performed, and the operation is skipped to the outlet (step 10), and returns to the main program. In step 2, the discrimination is made as to whether or not the film is shifted to the front side. For this discrimination, a content of the RAM at a predetermined address in the microcomputer 66 is set as a rear side flag, and the discrimination is made as to whether the memory is 1 or 0. When the film is going to shift toward the front side, that is, the rear side flag is 0, a step 3 is executed. In step 3, the discrimination is made as to whether the sensor 96 is actuated or not. If not, the step 4 is executed wherein the discrimination is made as to the sensor 86 is actuated or not. If so, a step 5 is executed. In this step, since the film shifts toward the front side to such an extent that the sensor 86 is actuated, and therefore, the solenoid 53 is energized to displace the film toward the rear side, and simultaneously, the rear side flag is set. Then, the operation goes to step 10 (outlet). In step 4, if the sensor 86 is not actuated, the operation skips to the outlet of step 10.

By on-off controlling the solenoid 53 in response to the on-output of the sensors 96 and 86, the film 25, during the normal operation, is maintained within the range determined by the sensors 96 and 86 and the masked portions 251 and 252 of the film.

In case where the shift control is disabled by malfunction of the solenoid or by introduction of foreign matter, and the sensor 96 is actuated in step 3, that is, in case where the film is moved rearwardly despite the control operation is performed to displacement frontwardly, an operation of step 7 is performed to set a film wrong flag is set, and then, step 8 is executed in which the solenoid 53 is deenergized, and the rear side flag is reset. Then, step 10 is executed to return to the main sequential control program. Similarly, in step 2, when the film is going to shift rearwardly, that is, when the rear side flag is 1, the operation of step 6 is executed. In step 6, the discrimination is made as to whether the sensor 85 is actuated or not. If so, that is, the film moves further frontwardly despite the control is effected to displace it rearwardly, the step 9 is executed, and the operation returns to the main program, similarly. If the sensor 85 is not actuated in step 6, the operation of step 7 is executed, and the discrimination is made as to whether the sensor 97 is actuated or not. If not, the operation skips to the step 10, and the operation returns to the main program. If the sensor 97 is actuated, the operation of step 8 is executed, in which the solenoid 53 is deenergized to displace the film frontwardly, and simultaneously, the rear side flag is reset, and the operation advances to step 10, by which is returned to the main program.

Figure 19:
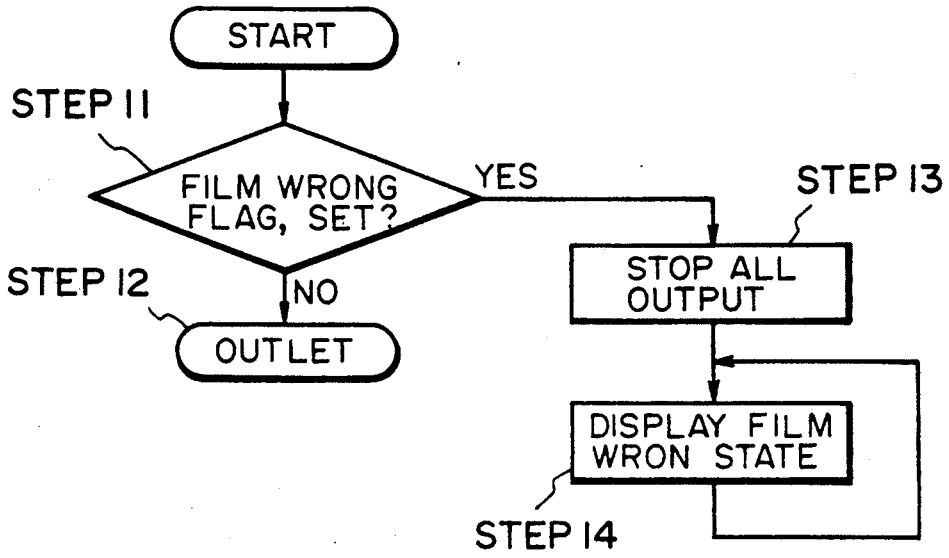

FIG. 19 is a flow chart of a film wrong or error program which is a part of the main program. In step 11, the discrimination is made as to whether the film error flag is set or not. If not, the sequence proceeds to step 12, and the next step of the main sequential program is executed. If the film error flag is set in step 11, a step 13 operation is executed by which all of the outputs of the entire apparatus (the copying apparatus in this embodiment) are stopped. Then, a step 14 is executed to display the film error. The step 14 constitutes a permanent loop to prohibit execution of the main program.

As described hereinbefore, upon motor rotation, the endless film 25 of the fixing apparatus is first control to be shifted toward the front side, and when the film position sensor 86 detects the shift of the film to the front side, the solenoid 53 is actuated to shift the film toward the rear side. Similarly, the film shifted to the rear side is detected by the film position sensor 97. When the shift to the rear side is detected, the solenoid 53 is deenergized to shift the film toward the front side. By repeating those operations, the film 25 is always maintained in the range between the sensors 86 and 97, and simultaneously, when the sensors 85 and 96 disposed outside the sensors 86 and 97 detects the event that the film is erroneously shifted due to malfunction of the solenoid 53 or the spring 79, the operation of the apparatus is stopped, thus preventing the damage of the film, and also, the error in the fixing apparatus is displayed to notify it to the operator. In addition, by performing the film error program shown in FIG. 19, each time the image forming operation is completed, the film error program is executed upon the image forming operation completion, if the error is detected during the image forming operation; by which the operation of the apparatus can be stopped, and the next image forming operation can be disabled. In this case, this is possible if the film 25 error detecting position is disposed more inside the position where the film 25 is actually damaged by a distance longer than a distance through which the film 25 moves in the time period required for one image formation. By doing so, even if the film error is detected during the image formation, the very image during the image formation can be normally outputted, so that any incomplete image is not retained in the apparatus, and therefore, the operator does not need to remove the incomplete image sheet from the apparatus.

In this embodiment, the sensors 86, 97, 85 and 96 are of transparent type, but other sensors of microswitch type or a reflection type photosensor may be similarly used.

Figure 20:
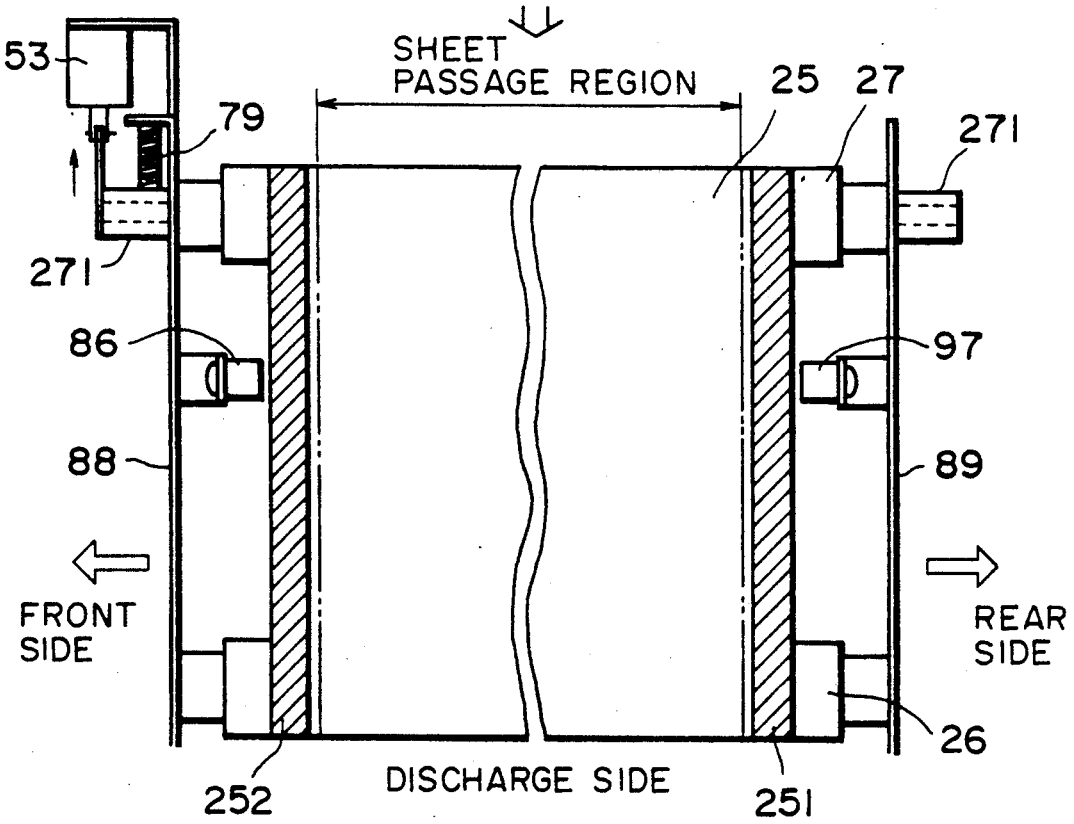
FIG. 20 is a top plan view of an image fixing apparatus according to a further embodiment of the present invention.

Referring to FIG. 20, a further embodiment of the present invention will be described. As compared with the embodiment of FIG. 16, this embodiment is deprived of the sensors 85 and 96. Also, the electric control system does not include the sensors 85 and 96, as compared with FIG. 17 structure, and therefore, it is not shown in Figure.

Figure 21:
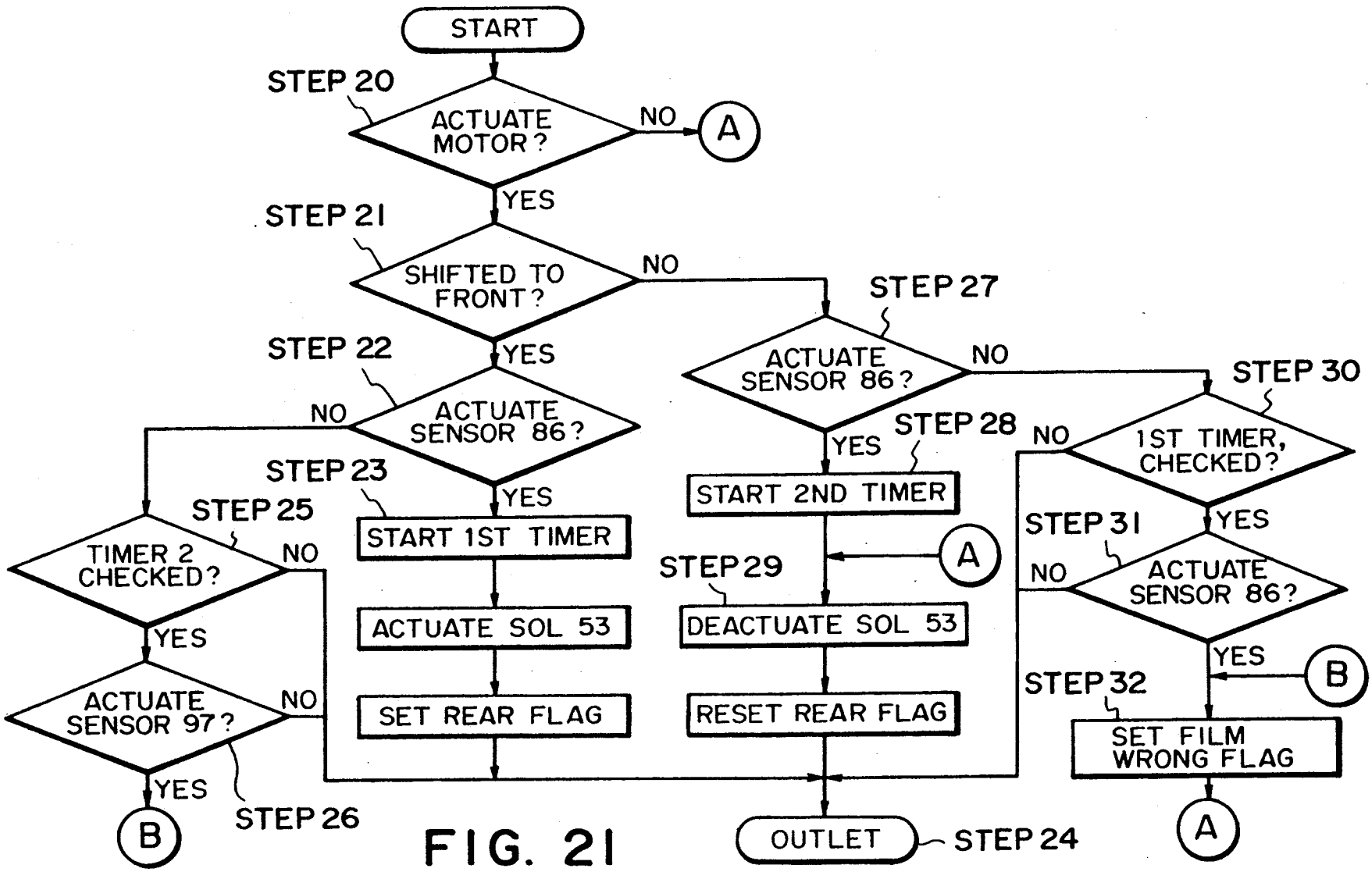
FIG. 21 is a flow chart of the control system for the apparatus of this embodiment.

FIG. 21 is a control flow chart for the embodiment of FIG. 20. Similarly to FIG. 17 embodiment, the control program of this embodiment is accessed by the main sequential program and is executed. After the start, the discrimination is made as to whether the motor 67 is actuated or not, at step 20. When the motor 67 is not actuated, the step 29 is executed by which the solenoid 53 is deenergized, and rear side flag is reset, and then the operation proceeds to the outlet at step 24. If the motor 67 is actuated in step 20, the operation of step 21 is executed in which the shift control program is performed. In step 21, the discrimination is made as to whether the film is going to shift rearwardly or frontwardly. Here, the rear side flag is checked. If the rear side flag is zero, that is, if the film 25 is going to shift frontwardly, the step 22 is executed by which the discrimination is made as to whether the sensor 86 is actuated or not. If so, that is, if the film 25 shifts to the sensor 86, the operation of step 23 is performed. In step 23, a timer 1 having a timer period of T1 sec, is started, and the solenoid 53 is energized to control to shift the film rearwardly. Then, the rear side flag is set, and the operation advances to the outlet at step 24, and returned to the main program. If the sensor 86 is not actuated at step 22, the operation of step 25 is carried out. In step 25, the discrimination is made as to whether or not a timer period T2 sec of a timer 2 as passed or not. If not, the operation advances to step 24 (outlet), if so, step 26 is executed, wherein the discrimination is made as to whether the sensor 97 is actuated or not. If not, the operation skips to the step 24 (outlet). If so, that is, the rear side sensor 97 detects the film 25 even if the control is effected to shift it frontwardly and even if the predetermined period T2 sec as passed, operation of step 32 is executed to set the film error flag, and the operation is advanced to the outlet at step 24 through a step 29 and then, is returned to the main program.

If the rear side flag is 1 at step 21, that is, if the film 25 is going to shift rearwardly, the operation of step 27 is executed. In step 27, the discrimination is made as to whether or not the sensor 97 is actuated. If so, that is, if the film 25 moves to the position of the rear sensor 97, the operation of a step 28 is performed. In this step, a timer in having a timer period of T2 sec is started, and an operation in step 29 is executed in which the solenoid 53 is deenergized to displace the film 25 frontwardly, and the rear side flag is reset to zero. Then, the operation advances to the outlet at step 24. If the sensor 97 is not actuated in step 27, the operation of step 30 is executed, wherein the discrimination is made as to whether the timer period T1 sec of the timer 1 has passed or not. If not, the operation skips to the outlet (step 24). If so, the operation of step 31 is executed in which the discrimination is made as to whether or not the sensor 86 is actuated. If not, the sequence proceeds to the step 24 (outlet). If so, that is, even if the control is such as to displace the film 25 rearwardly, the front sensor 86 detects the film even if the predetermined timer period T1 has passed, the operation of step 32 is executed, and the film error flag is set. The operation proceeds to the outlet (step 24) through the step 29, and is returned to the main program.

In the processing in the main program, is the same as the embodiment shown in FIG. 19, and in response to the film error flag, the operation of the main apparatus sequential control is disabled, and simultaneously, the error can be informed to the operator by the display of the film error.

As described in the foregoing, upon the motor rotation, the endless film 25 of the fixing apparatus of this embodiment is controlled to be displaced toward the front, and when the film position sensor 86 detects the event that the film 25 is shifted to the front side, the solenoid 53 is energized, so that the control is switched to the control for shifting the film 25 to the rear side. At this time, the timer 1 for measuring the predetermined timer period T1 is started. Then, the film 25 is considered to displace toward the rear side. After the timer period T1 elapses, the chip is made as to whether the sensor 86 is actuated or not. If the film 25 is not moved to the sensor 86, the film error is detected. Similarly, when the film 25 is shifted to the rear side to such an extent that the rear side sensor 97 is actuated, the solenoid 53 is deenergized to displace the film 25 toward the front side, and simultaneously, the timer 2 for measuring the timer period T1 is started. By this, the film moves toward the front side. Similarly to the case where the film is moved to the rear side, after the timer period T2 of the timer 2 elapses, the check is made as to whether the sensor 97 is actuated or not. If the film 25 is not moved to the front side to the sensor 97, the film error is discriminated. If the fixing apparatus is in order, the film 25 is controlled in its position by the sensors 86 and 97.

The setting of the predetermined periods T1 and T2 will be described. Each of those periods is longer than the time required after the front side sensor 86 or the rear side sensor 97 detects the film 25 and the shift control is effected in the opposite direction, and before the film is not detected by the sensor. Each of the time period is shorter than the period for the film to move to such a position where the film is damaged by the side plate or the like, after the sensor 86 or 97 detects the film, when the control is not possible. By selecting the time period in this manner, the shift control of the endless film and the error in the film position can be detected.

Figure 22:
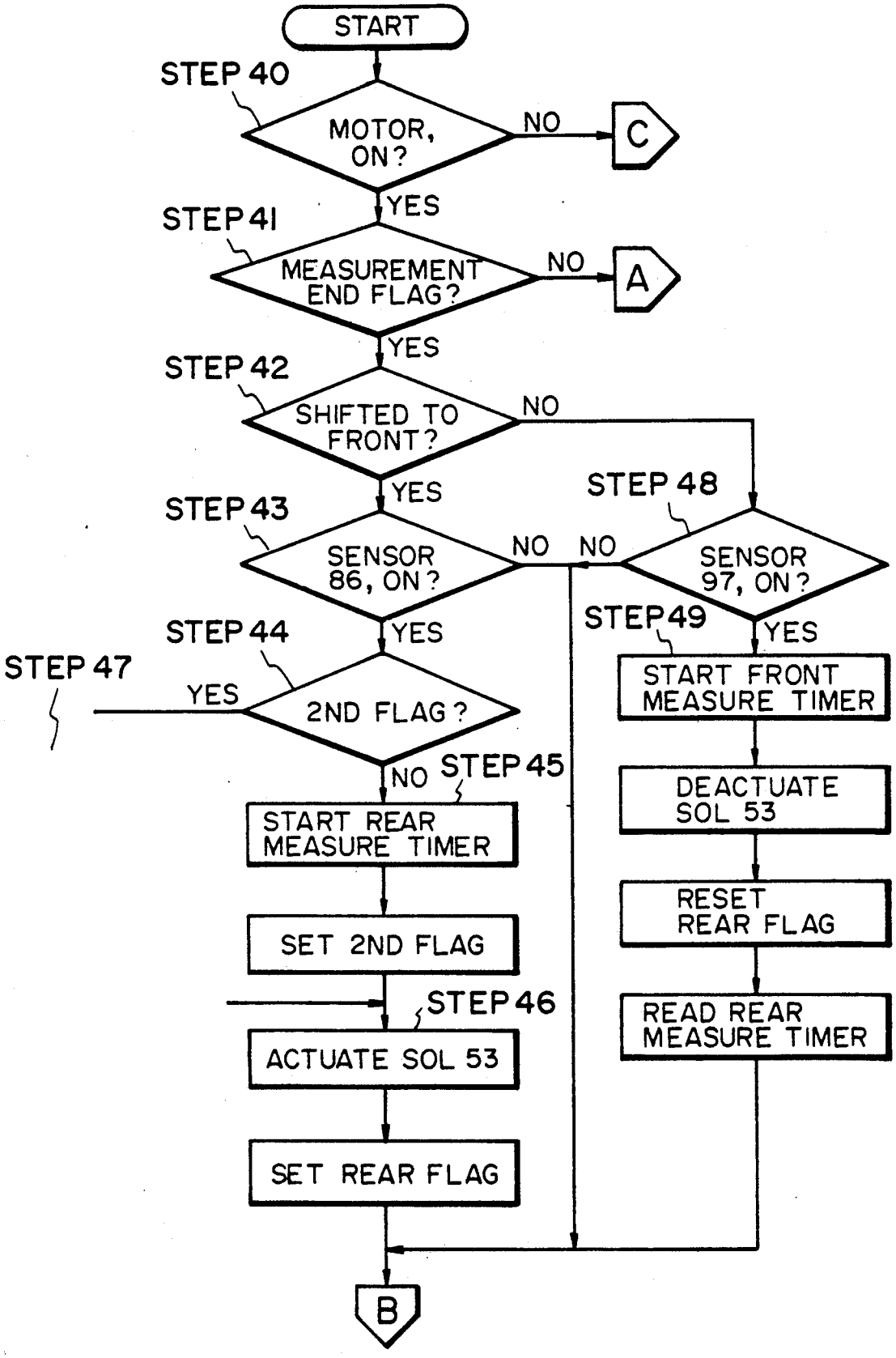
FIGS. 22, 23 and 24 are flow charts of another example.
Figure 23:
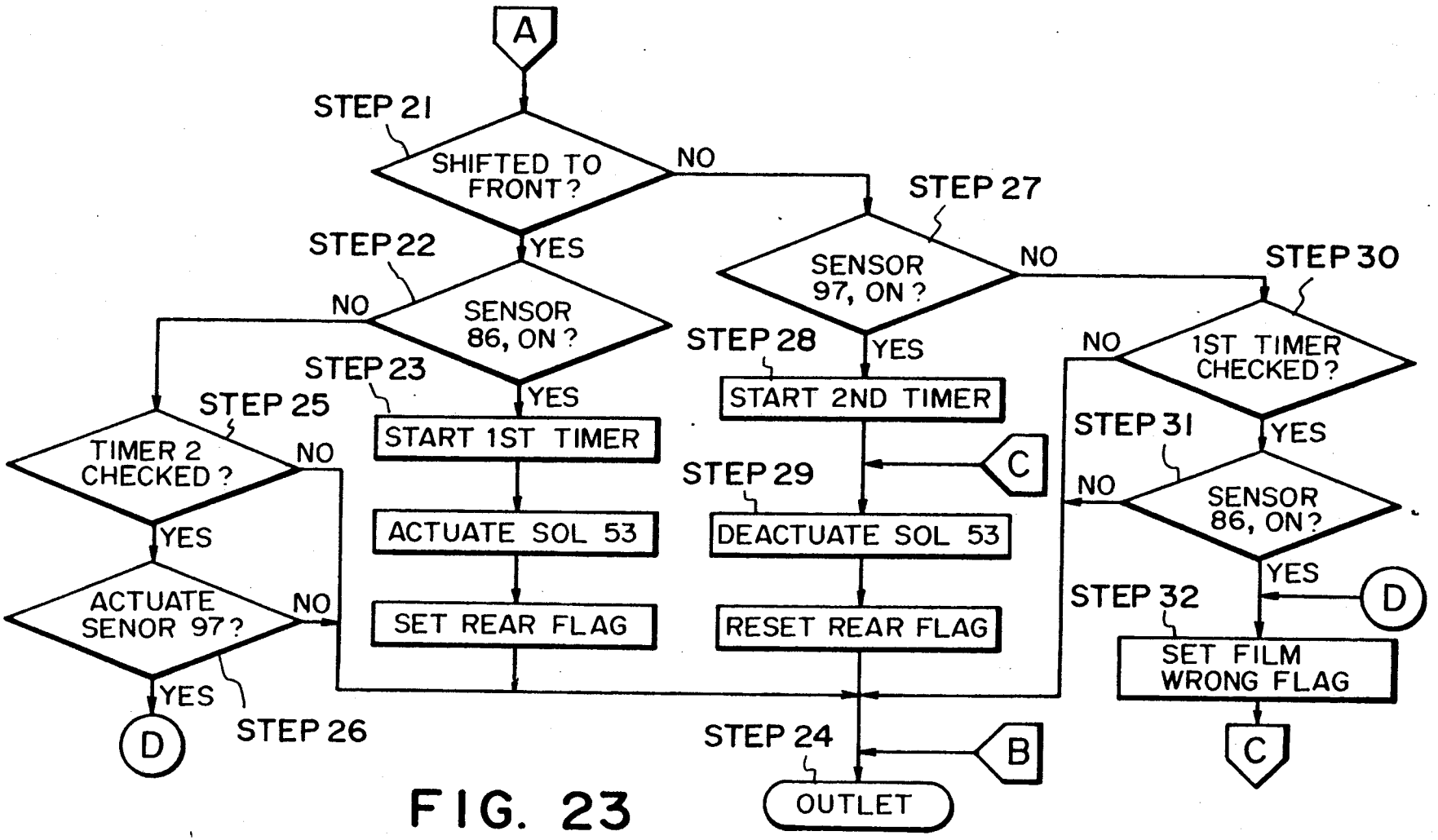

Referring to FIGS. 22 and 23, an apparatus according to a further embodiment of the present invention will be described. Those Figures show flow charts, and the other structures are the same as in FIG. 20 embodiment. Referring to FIGS. 22 and 23, the operation will be described. At step 40 in FIG. 22, the discrimination is made as to whether or not the motor is actuated. If not, the operation of step 29 of FIG. 23 is effected, wherein the solenoid 53 is deactuated, and the rear side flag is reset, and thereafter, the operation proceeds to the outlet at step 24, similarly to the foregoing embodiment. If the motor is actuated at step 40, the operation of step 41 is executed, wherein the measurement completion flag is checked. If the measurement completion flag is zero, the operation of step 42 is executed. In step 42, the discrimination is made as to whether the film 25 is going to move to the front or to the rear. Here, the rear side flag is checked. If the rear side flag is zero, that is, if the film 25 is going to shift to the front side, the step 43 is executed. In step 43, the discrimination is made as to whether the sensor 86 is actuated or not. If not, the operation proceeds to step 24 (outlet) of FIG. 23. When the sensor 86 is actuated, the operation of step 44 is performed, wherein a second flag is checked. If the second flag is zero, that is, if the film 25 first comes to the front side sensor, the operation in step 45 is executed. In step 45, the rear side measurement timer is start, and the second flag is set to 1. Then, step 46 is executed by which the solenoid 53 is energized to shift now the film 45 to the rear side, and the rear flag is set to 1, and the operation proceeds to step 24 of FIG. 23.

If the discrimination is made that the film is shifted to the rear side at step 42, that is, rear side flag is 1, step 48 operation is carried out. In step 48, the discrimination is made as to the sensor 97 is actuated or not. If the film 25 does not reach the position of the sensor 97, the operation proceeds to the outlet at step 24 (FIG. 23). If the sensor 97 is actuated, that is, if the film 25 is displaced to the rear side, the operation of step 49 is performed. In step 49, the front side measurement timer is started, and simultaneously therewith, the solenoid 53 is deenergized to displace now the film 25 toward the front side, and the rear side flag is reset to zero. Then, the rear side measurement timer is stopped, and the timer period is read and is written in the RAM in the microcomputer 66 at a predetermined address. Then, the operation proceeds to the step 24, outlet (FIG. 23).

If the second flag is discriminated as being 1 in step 44, that is, if the film reaches the position of the sensor 86 for the second time after the film 25 first reaches the sensor 86, is displaced to the rear side sensor 97 by the control, and the control is switched to displace the film 25 back to the front side, the operation of step 47 is performed. In step 47, the front side measurement timer is stopped, and the timer period is read. The timer period is the period required for the film 25 to displace from the sensor 97 position to the sensor 86 position toward the front side. Since the distance between the sensors 86 and 97 and the width of the film are known, the distance of the film movement toward the front per unit time is measured. Similarly, the distance through which the film 25 moves per unit time toward the rear side is determined from the rear side measurement timer. The detecting timing of each of the sensors 86 and 97 can be calculated from the movement distance per unit time and the distance between the position where the sensor 86 or 97 detects the film 25 and the film displaces to such a position that it is not detected by the sensor after the opposite displacement control. In addition, the error detecting timing can be calculated from the position where the sensor 86 or 97 detects the film and a position where the film is damaged by the side plate or the like. Here, the time periods which are longer than the period to the detection timings and shorter than the periods to the error detecting timing are calculated, and they are set in the timer 1 and the timer 2, respectively. In this embodiment, the calculation program is constructed such that the timer periods T1 and T2 are the center between the detection timing and the error detecting timing. After the timer periods T1 and T2 are set, the measurement completion flag is set to 1, and the operation of step 46 is performed wherein the solenoid 53 is actuated by which the film 25 is shifted to the rear side. Then, the rear side flag is set to 1, and thereafter, the operation proceeds to the outlet at step 24 (FIG. 23).

If the measurement completion flag is 1 in step 41, that is, after the moving periods to the front side and the rear side are measured, the timer periods T1 and T2 are calculated and are set, the operation of a step 21 (FIG. 23) is performed. The operation after the step 21 is the same as in FIG. 21 embodiment, and thereafter, the description is omitted for simplicity.

As described hereinbefore, by determining the speed at which the film shifts toward the rear and the front at the initial stage of the shift control, the timing of error detection can be selected most properly, and simultaneously, the assured shift control and assured film position error detection are possible without increasing very much the assembly precision of the driving roller 26, the follower roller 27, the heater 20 and the pressing roller 28.

Figure 24:
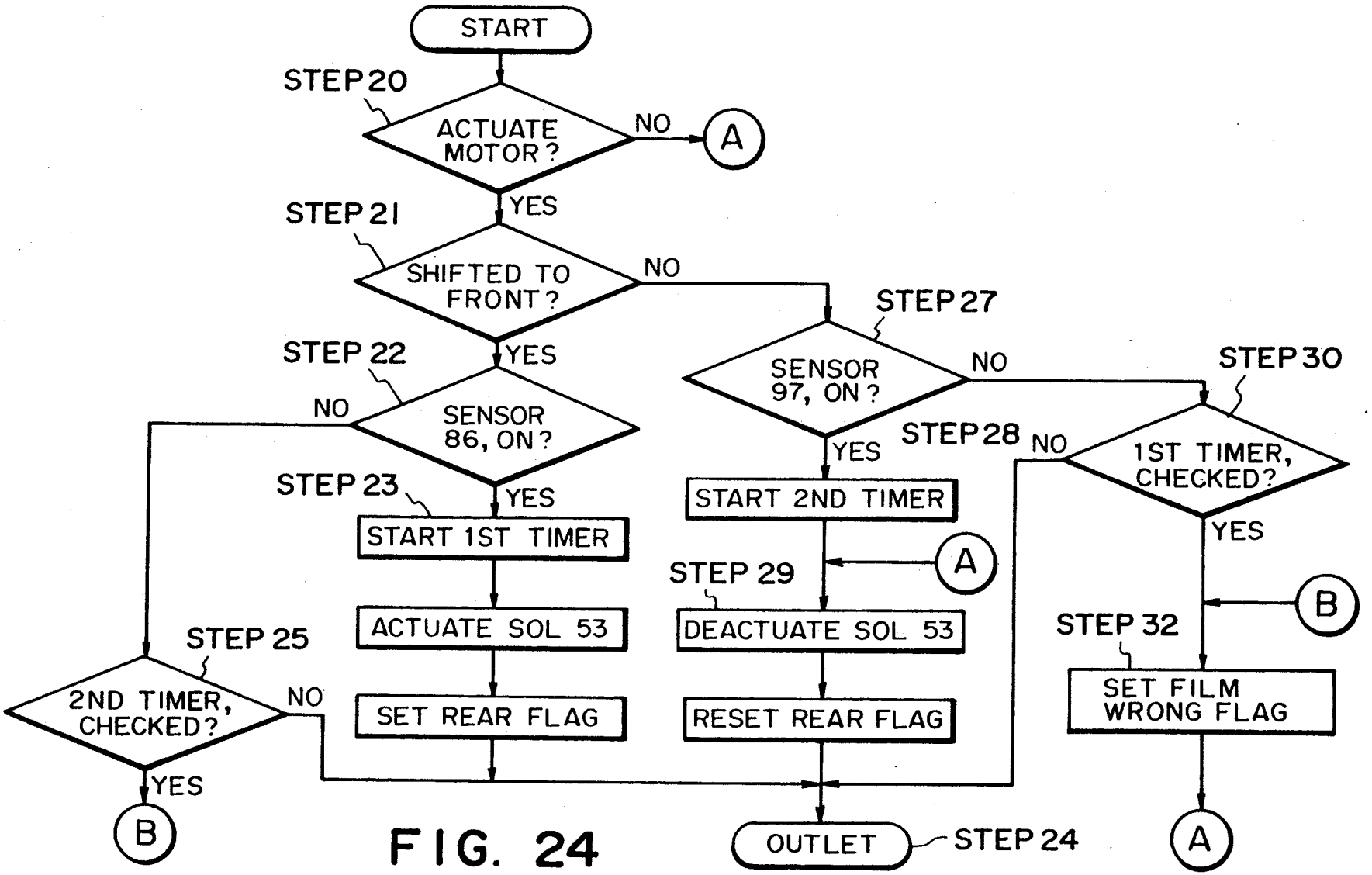

Referring to FIG. 24, a further embodiment will be described. This embodiment is a modification of FIG. 21 embodiment, the structure other than the control flow chart is the same as that of FIG. 21 embodiment.

After the start, the discrimination is made as to whether or not the motor 67 is actuated at step 20. If not, the operation of step 29 is carried out by which the solenoid 53 is deenergized, and the rear side flag is reset, and thereafter, the operation proceeds to the outlet at step 24. If the motor 67 is actuated in step 20, the operation of the step 21 is performed, by which the shift control program is executed. In step 21, the discrimination is made as to whether the film 25 is going to shift to the rear side or to the front side. Here, the rear side flag is checked. If it is zero, that is, if the film 25 is going to shift toward the front side, the operation of step 22 is executed, by which the discrimination is made as to whether the sensor 86 is actuated or not. If so, that is, if the film 25 reaches the sensor 86, the operation of step 23 is carried out. In step 23, the timer 1 for measuring a predetermined timer period T1 sec is started, and then, the solenoid 53 is energized to displace the film toward the rear side. Then, the rear side flag is set, and the operation proceeds to the outlet at the step 24, and is returned to the main program. If the sensor 86 is not actuated in step 22, the operation advances to step 25, wherein the discrimination is made as to whether the timer period T2 of the timer 2 has passed or not. If not, the operation proceeds to the outlet at step 24. If so, that is, if the film 25 does not displace to the position of the front side sensor 86 even if the predetermined timer period T2 elapses despite the control to the film 25 toward the front side, the operation of step 32 is executed, wherein the film error flag is set, and the operation proceeds to the outlet at step 24 through a step 29, and is returned to the main program.

If the rear side flag is 1 at step 21, that is, if the film 25 is displacing toward the rear side, the operation of step 27 is executed in which the discrimination is made as to whether or not the sensor 97 is actuated. If so, that is, the film 25 has moved to the position of the rear side sensor 97, the operation of step 28 is executed. In step 28, the timer 2 for measuring a predetermined timer period T2 sec is started, and step 29 is executed, by which the solenoid 53 is deenergized to shift the film 25 toward the front, and the rear side flag is reset to zero, and thereafter, the operation proceeds to the outlet at step 24. If the sensor 97 is not actuated at step 27, an operation of step 30 is performed. In step 30, the discrimination is made as to whether the timer period T1 of the timer 1 has passed or not. If not, the operation proceeds to the outlet at step 24. If so, that is, if the film does not displace to the position of the rear side sensor 97 even if the predetermined period T1 sec has passed despite the control to the film 25 toward the rear side, the operation of step 32 is carried out, in which the film error flag is set, and the operation advances to the outlet at step 24 through the step 29 and is returned to the main program.

The operation in the main program is the same as in FIG. 19 embodiment. In response to the film error flag, the sequential operation of the main apparatus is disabled, and the film error is displayed to inform the operator of the error.

As described in the foregoing, the film 25 is controlled to move to the front upon motor rotation, and thereafter, when the film position sensor 86 detects the film 25 at the front side, the solenoid 53 is energized to displace the film 25 now to the rear side. Simultaneously, the timer 1 for measuring the predetermined period T1 sec is started. Next, the film 25 displaces toward the rear. If the rear side sensor 97 is not actuated even if the timer period T1 of the timer 1 passes, the film error is detected. If the film 25 is shifted to the rear side sensor 97 prior to the elapse of T1 sec, and the sensor 97 is actuated, the solenoid 53 is deenergized to displace the film 25 toward the front, and simultaneously, the timer 2 for measuring the predetermined timer period T2 is started. By this, the film 25 is displaced toward the front side. Similarly to the case of the movement toward the rear, the film error is detected if the front side sensor 86 is not actuated even if the timer period T2 elapses. The selection of the timer period T1 and T2 will be described. First, the period T1 is longer than the period required for the film 25 to shift from the front side sensor 86 position to the rear side sensor 97 position. The period T2 is longer than the time required for the film 25 from the rear sensor 97 to the front sensor 86. The period T1 is shorter than the time period required for the film 25 to the front beyond the front sensor 86 to such a position that the film is damaged by a front side plate or the like. Similarly, the period T2 is shorter than the period required for the film to displace to the rear side beyond the rear sensor 97 to a position where the film is damaged by the rear side plate or the like.

Figure 25:
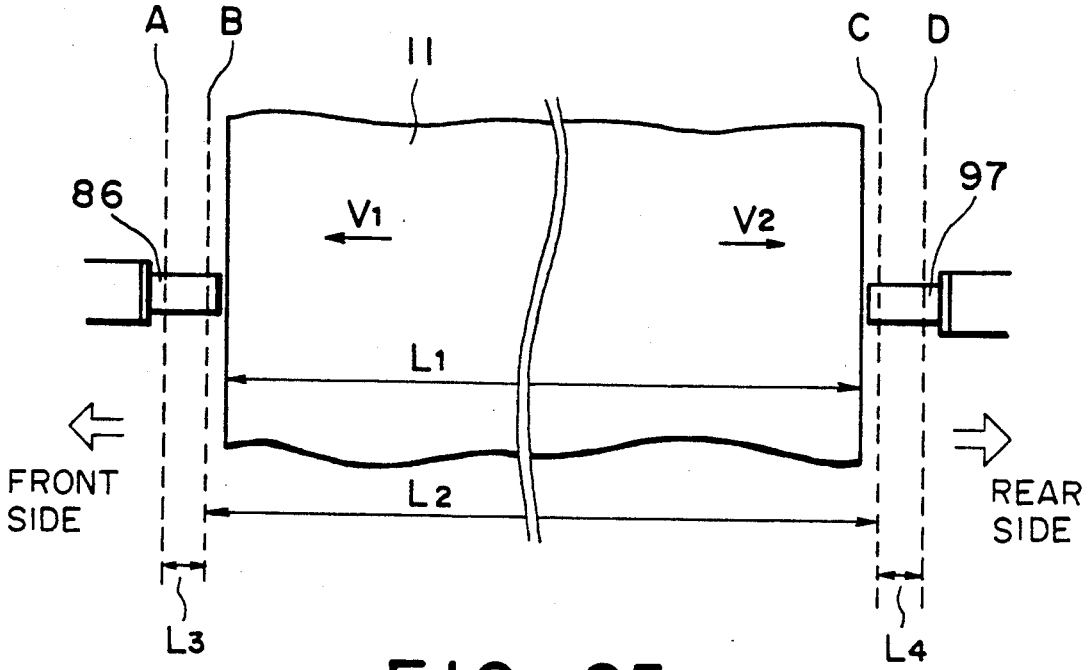
FIG. 25 is a top plan view of an apparatus according to a further embodiment of the present invention.

FIG. 25 shows the positional relations among the sensors and the film to meet the above requirements for the periods T1 and T2. The position indicated by a reference A is a front side limit position, and if the film 25 is displaced toward the front beyond this limit position, the film 25 is damaged. The position indicated by a reference B is a film detecting position by the front sensor 86. References C and D designate a film detecting position of the rear sensor 97, and a rear side limit position.

The width of the film and the positions of the sensors satisfy:

$$(L2-L1)/V2<T1<L3/V1$$

$$(L2-L1)/V1<T2<L4/V2$$

where L1 is a width of the film; L2 is a width of the film control range, that is, the distance between the points B and C; L3 is a distance between the film detecting position of the front sensor 86 and the front side limit position, that is, the distance between the points A and B; L4 is a distance between the film detecting position of the rear sensor 97 and the rear side limit position, that is, the distance between the points C and D; T1 and T2 are the timer periods described above; V1 is a speed of the film 25 toward the front; and V2 is the speed of the film 25 moving toward the rear.

According to this embodiment, the shift control of the endless film and the film error detection are possible, and simultaneously, the error detection is possible when the film is creased, with the result of the change in the width, or when the moving speed is changed.

Figure 26:
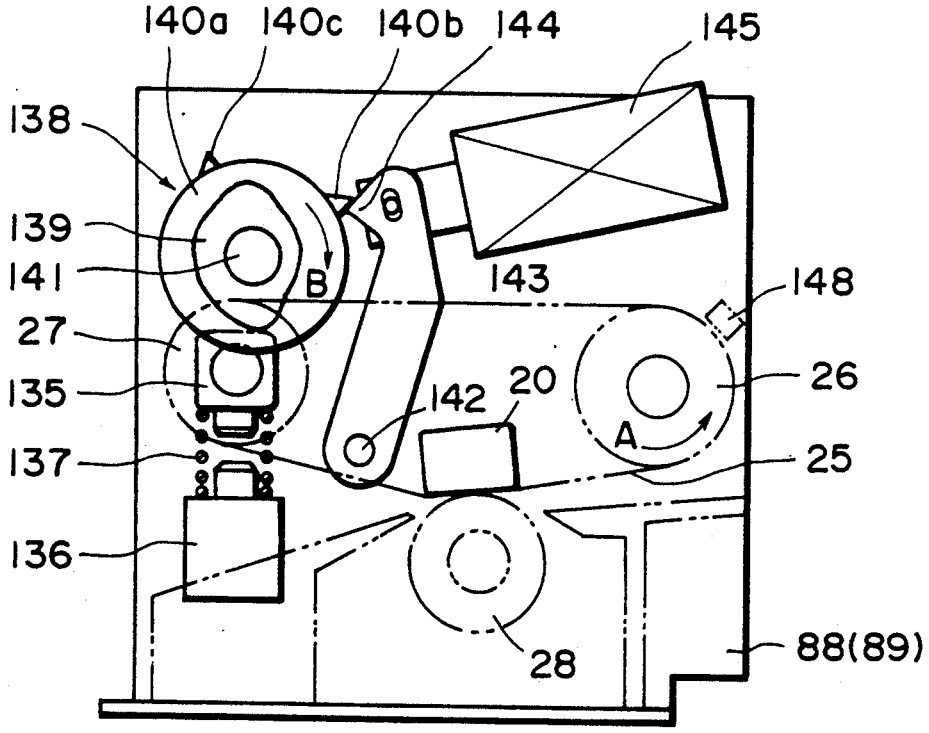
FIG. 26 is a view of an image fixing apparatus according to a further embodiment, seen from a rear side in a certain state.
Figure 27:
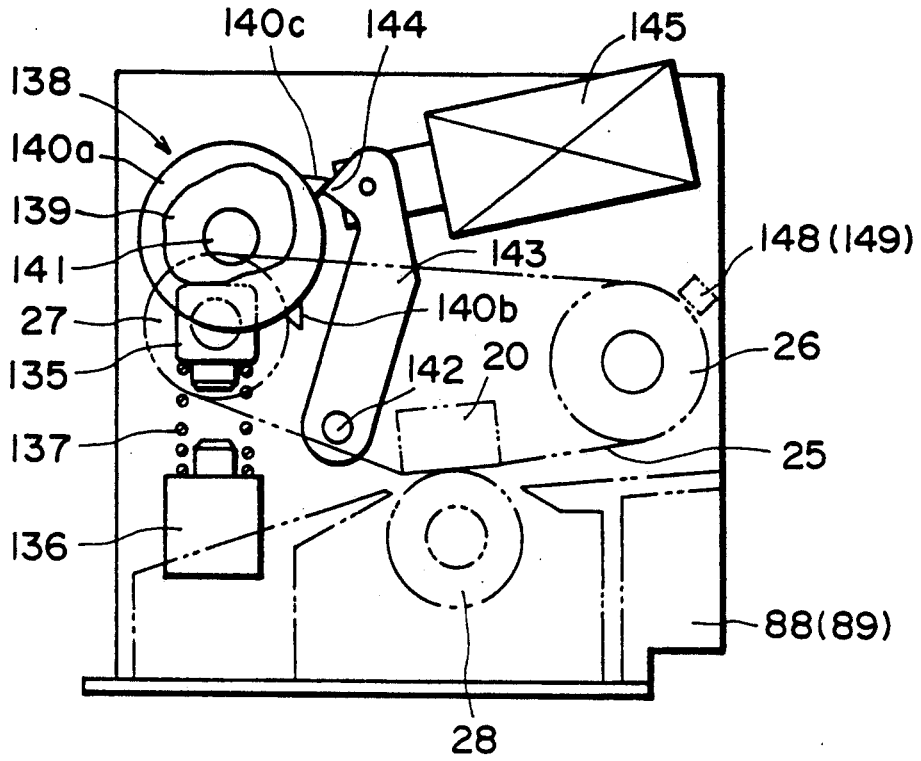
FIG. 27 is the same view of a different state, of the apparatus of FIG. 26.

Referring to FIGS. 26 and 27, an image fixing apparatus according to a further embodiment of the present invention will be described. In the state shown in FIG. 26, a rear side bearing 135 of the follower roller 27 is raised, whereas in the state shown in FIG. 27, the rear side bearing 135 of the follower roller 27 is raised by the spring 137.

The bearing 135 of the follower roller 27 is supported on a side plate 88 for sliding movement in substantially the vertical direction, and its rotatably supports an end of the follower roller 27. The other end of the follower roller 27 is rotatably supported in a bearing (not shown) mounted in another side plate 89.

A fixing member 136 mounted to the side plate 88 supports an end of a spring 137 for urging the bearing 135 upwardly, and the bottom end of the bearing 135 urges the other end of the spring 137. A spring clutch 138 includes a coil spring (not shown) having an input hub (not shown) and controlling pawl (not shown), a control collar 140*a* and an output have 141. When, as shown in FIGS. 26 and 27, an engaging pawl 140*b* or 140*c* is engaged with a lever pawl 144 and is stopped thereby, the power of the input hub is not transmitted to the output hub 141. When the lever pawl 144 is disengaged from the engaging pawl 140*b* or 140*c*, the control collar 140*a* becomes rotatable, by which the driving force is transmitted from the input hub to the output hub 141. To the input hub, the driving force is always transmitted in the direction B through a gear or gears (not shown).

To the output hub 141, a cam 139 having a radius which is different depending on the angular position thereof is fixed for integral rotation. As shown in FIG. 26, when the engaging pawl 140*b* and the lever pawl 144 are engaged, the bottom side radius of the cam 139 is the maximum. When the engaging pawl 140*c* and the lever pawl 144 are engaged, as shown in FIG. 27, the bottom radius of the cam 139 is the minimum. The radius therebetween smoothly changes.

Therefore, in the state wherein the engaging pawl 140*b* is engaged with the lever pawl 144, the maximum radius of the cam 139 lowers the bearing 135, whereas when the engaging pawl 140*c* is engaged with the lever pawl 144, the bearing 135 is urged upwardly by the spring 137.

A lever 143 is rotatably supported on a pin 142 planted on the side plate 88, at the end thereof, a lever pawl 144 is formed, and the other end is connected with an operating rod of a solenoid 145. The solenoid 145 is energized for a predetermined period of time in response to signals from sensors 148 and 149, which will be described hereinafter.

The sensors 148 and 149 detects that the fixing film or a heat-resistive belt 25 is moved toward the rear or the front from the initial position through a predetermined distance. The output signals from the sensors 148 and 149 are amplified by a known control circuit, and in response to the signals, the solenoid 145 is energized for a predetermined period of time, and the cam 139 is maintained at a desired position.

Figure 28:
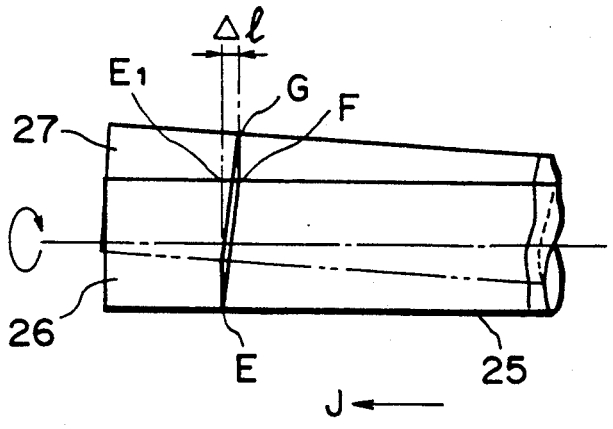
FIG. 28 shows a shift of a heat-resistive belt of FIGS. 26 and 27.
Figure 29:
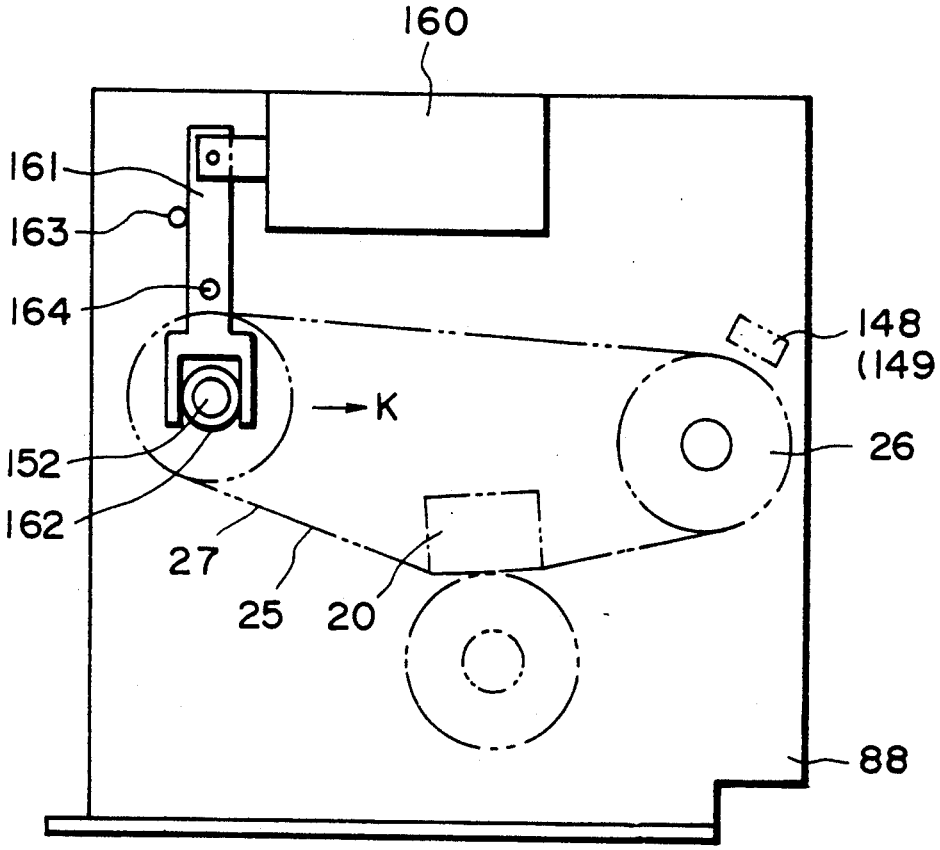
FIG. 29 is a side view according to a further embodiment of the present invention.

Referring to FIG. 28, the description will be made as to how the shifting detection of the heat-resistive belt 25 changes by the up and down movement of the follower roller 27. FIG. 29 shows the major part illustrating the heat-resistive belt 24, as seen from the sheet discharge side.

As described hereinbefore, when the cam 139 shown in FIG. 26 rotates, and the end of the follower roller 27 raised upwardly by the spring 137, the belt 25 is wrapped inclinedly with respect to the axes of the follower roller 27 and the driving roller 26. More particularly, the belt 25 is first wrapped in the region EF of the driving roller 26, and it starts to be wrapped on the follower roller 27 at the point G, and is wrapped in the region GH, and then it is wrapped on the driving roller again at the point E. When the driving roller 27 rotates in the direction indicated by an arrow, the end of the belt 25 wrapped at the point E, moves in a direction perpendicular to the axis of the driving roller 26, and therefore, when the driving roller 26 rotates approximately through 180 degrees, it is shifted to the point E1. In other words, the belt 25 is shifted in the direction of an arrow J by a distance Δd which is a distance between the point F and the point E1. Therefore, when the driving roller 26 continues to rotate in this state, the belt 25 gradually shifts in the direction J. When the heat-resistive belt 25 shifts beyond a predetermined amount, the sensor 148 detects the end of the belt, in response to which the solenoid 145 is energized for a predetermined period of time to rotate the cam 139. The rotation of the cam 139 lowers the follower roller 27 so that it is inclined in the opposite direction. Therefore, the shifting tendency of the belt 25 is reversed. By repeating this, the belt 25 is reciprocally displaced at a low speed within a predetermined range, thus preventing the lateral end of the transfer sheet P are contacted always at the same positions.

In the foregoing embodiment, the angular positions of the engaging pawls 140*b* and 140*c* are spaced by approximately 90 degrees. This is because the solenoid 145 energization period is made longer than the time period corresponding to the angular position of the engaging pawls 140*b* and 140*c* without using a cam position detecting switch or the like. Therefore, when the cam position detecting switch or the like is employed, the angular positions of the engaging pawls 140*b* and 140*c* may be different.

In this embodiment, in order to shift the belt 25, the follower roller 27 is screwed. However, the present invention is not limited to this structure. The heat-resistive belt 25 may be positively shifted by changing the distance between the rollers. The means for changing the roller position is not limited to the structure wherein the clutch 138 and a trigger solenoid are used. For example, the end of the shaft is directly moved by the solenoid.

FIG. 29 shows a further embodiment, wherein the distance between the follower roller 27 and the driving roller 26 is changed to positively shift the heat-resistive belt 25.

In FIG. 29, a solenoid 160 is fixed on a side plate 88. An end 152 of the follower roller 27 is rotatably supported by a bearing 162. The bearing 162 is engaged with an elongated slot (not shown) formed in the side plate 88 and is movable in the horizontal direction. The supporting shaft 164 is planted on the side plate 88 and rotatably support the lever 161. A top end of the lever 161 is engaged with the operating rod of the solenoid 160, and the bottom end of the lever 161 is engaged with the bearing 162. When the solenoid 160 is not operated, the bearing 162 is pulled in the direction K by the tension of the heat-resistive belt 25. A pin 163 planted on the side plate 88 is effective to limit the movement of the lever 161.

When the solenoid 160 is not operated, the lever 161 is contacted to the bin 163, and at this time, the bearing 162 is closer to the driving roller 26 by a small distance than a bearing (not shown) at the opposite side of the follower roller 27. When the solenoid 160 is energized, the lever 161 rotated in the clockwise direction about a pin 164, so that the bearing 162 is away from the driving roller 26 by a small distance than the opposite side bearing of the follower roller 27. During the rotation, the heat-resistive belt 25 shifts toward the side where the distance between the roller axes is shorter. Therefore, when solenoid 160 is not energized, the heat-resistive belt 25 is shifted toward the rear side, whereas when the solenoid 160 is energized, it is shifted to the front side.

Sensors 148 and 149 are provided to energize or deenergize the solenoid 160 when the heat-resistive belt 25 is shifted by a predetermined amount. In the case shown in the Figure, when the heat-resistive belt 25 is moved too much to the rear side, the sensor 148 is actuated to energize the solenoid 160 to shift the heat-resistive belt 25 back to the front side. On the contrary, when the sensor 149 is operated, the solenoid 160 is deenergized, by which the heat resistive belt 25 is shifted toward the rear side.

Therefore, by controlling the distance between the follower roller 27 and the driving roller 26, the heat resistive belt 25 can be continuously moved toward the rear side and the front side within a predetermined range. Therefore, the heat resistive belt 25 is prevented from contacting the lateral edge of the transfer sheet P at the same position always.

Figure 30:
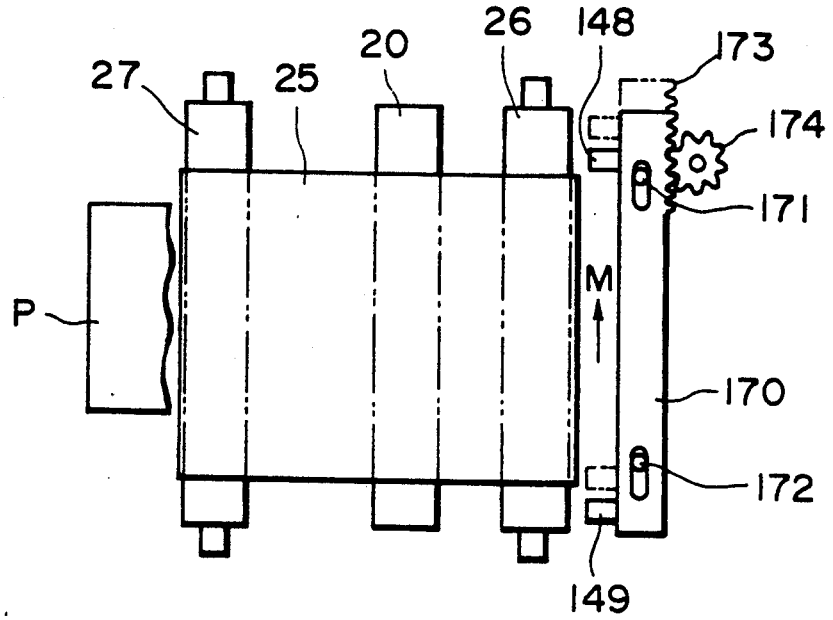
FIG. 30 is a top plan view of an image fixing apparatus according to a further embodiment of the present invention.

FIG. 30 shows a further embodiment, wherein the sensor is movable in the longitudinal direction, and the position of the sensor is moved in the longitudinal direction after a predetermined number of sheets are passed through the fixing apparatus, by which the reciprocable movable range along the length of the rollers is changed. The sensors 148 and 149 are mounted adjacent opposite end portions of a slider 170, and the sensor 148 detects a rear end of the heat resistive belt 25, and the sensor 149 detects the front end of the heat resistive belt 25. The slider 170 has an elongated slot at the rear side portion and the front side portion. The elongated slots are engaged with pins 171 and 172 mounted on a supporting plate (not shown). A rack 173 is formed at a side of the slider 170 opposite from the rear sensor 148, and a pinion gear 174 is meshed with the rack 173. The pinion gear 174 is rotated by an unshown actuator such as a small size motor or a plunger by the amount of several teeth at one time. After a predetermined number of sheets are passed, or after the heat resistive belt 25 rotates in a predetermined number, an electric signal is applied to the actuator, upon which the pinion gear 174 rotates in the clockwise direction through the amount corresponding to its several teeth, by which the sensors 148 and 149 move in the direction M to the position indicated by the chain lines. After the sensors 148 and 149 move to the chain line positions, the heat resistive belt 29 reciprocates within the range defined by the chain lines.

Since the conveyance position of the transfer sheet P is constant, the positions on the belt 25 contacted to the lateral edges of the transfer sheet P is shifted by the amount of the shift of the heat resistive belt 25, and therefore, the durability of the heat resistive belt 25 is improved.

In the foregoing description, the belt edge is detected by the sensor, and after the belt 25 is shifted by a predetermined distance, the event is fed back to reciprocate it between the sensors. However, it is possible that the shifting mechanism is operated after a predetermined number of sheets are passed.

Figure 31:
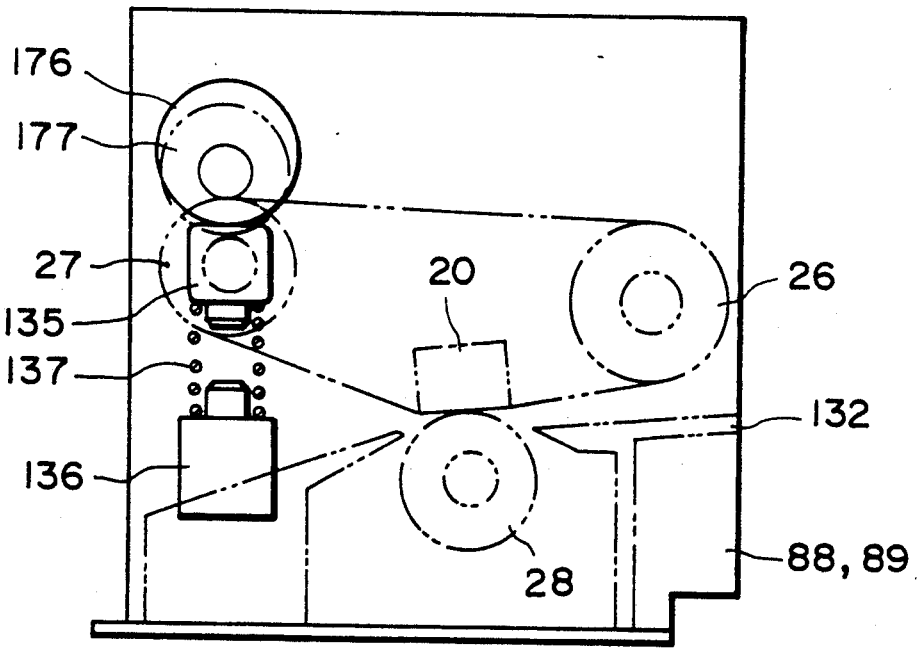
FIG. 31 is a side view of an image fixing apparatus according to a further embodiment of the present invention.

FIG. 31 shows such an embodiment. In the belt shifting mechanism of FIG. 31, an eccentric cam 176 integrally rotatable with a gear 177 is contacted to a top end of a one way bearing 135 of the follower roller 27, so that the bearing 135 is moved upwardly and downwardly in response to ½ rotation of the eccentric cam 176. After a predetermined number of sheets are passed, or after sheet jam occurs, the gear 177 is rotated through ½ full turn by a known actuator for each of a predetermined number of rotations of the heat-resistive belt 25, so as to shift the belt 25, thus preventing the same positions of the belt 25 is contacted to the edges of the transfer sheet P.

It is a possible alternative that the belt shifting mechanism operates after a predetermined number of sheets are passed, and the belt 25 is shifted in the predetermined direction gradually without reciprocating the heat-resistive belt 25, and when the belt 25 reaches a limit position defined at one side, it is exchanged with a fresh belt.

As described hereinbefore, the belt is always moved in a direction perpendicular to the conveyance direction of the heat resistive belt, whereby the local wearing of the heat resistive belt can be prevented, so that it is substantially uniformly worn, and therefore the durability of the heat resistive belt is increased.

In those embodiments, the film is shifted during the fixing operation, but it is a very slow shifting, and therefore, it does not influence the image fixing operation.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:
a heater;
a film through which a toner image on a recording material is heated by heat produced by said heater, said film being movable together with the recording material;
detecting means for detecting a position of said film in a direction perpendicular to its movement; and
control means responsive to an output of said detecting means for controlling the position of said film in the direction perpendicular to the movement of said film.

2. An apparatus according to claim 1, further comprising pressing means for pressing said heater, said film and said recording material.

3. An apparatus according to claim 1, wherein said heater is stationary during a fixing operation of said apparatus, and is slidable relative to said film.

4. An image fixing apparatus, comprising:
a heater;

an endless film through which a toner image on a recording material is heated by heat generated by said heater;

pressing means for forming a nip between said heater and said endless film, through which the recording material is passed;

a driving roller for driving said endless film;

a displacing means for controlling a position of said endless film in a direction perpendicular to a direction of said endless film;

wherein said displacing means is disposed upstream of the nip and downstream of said driving roller with respect to the rotational direction of said film.

5. An apparatus according to claim 4, wherein said displacing member includes a follower roller driven by said film and is effective to apply tension to said film.

6. An apparatus according to claim 4, wherein said heater is stationary during a fixing operation of said apparatus, and is slidable relative to said film.

7. An apparatus according to claim 6, wherein said heater includes a linear heat generating element extending in a direction crossing with a movement direction of said film.

8. An apparatus according to claim 7, wherein there is no air layer between said heat generating element and the toner image.

9. An apparatus according to claim 4, further comprising detecting means for detecting a shift of said film, and said displacing member is displaced in accordance with an output of said detecting means.

10. An apparatus according to claim 4, wherein said displacing member is disposed in an endless path of said film.

11. An image fixing apparatus, comprising:

a heater;

an endless film through which a toner image on a recording material is heated by heat generated by said heater;

detecting means for detecting a shift of said film; and control means for controlling a position of said endless film in a direction perpendicular to a direction of movement of said endless film;

wherein said control means operates during a period when an image fixing operation of said apparatus is not performed.

12. An apparatus according to claim 11, wherein when said detecting means detects the shift of said film before the image fixing operation of said apparatus, the image fixing operation is carried out after said control means controls the position of said film.

13. An apparatus according to claim 11, wherein when said detecting means detects a shift of said film during the fixing operation, said control means controls the position of said film after termination of the image fixing operation.

14. An apparatus according to claim 11, wherein said control means includes a tension member for applying tension to said film and displacing means for displacing the tension member, wherein the position of said film is controlled by displacing said tension member.

15. An apparatus according to claim 14, wherein said tension member is a follower roller rotatable following said film.

16. An apparatus according to claim 11, further comprising pressing means for pressing said heater, said film and said recording material.

17. An apparatus according to claim 11, wherein said heater is stationary during a fixing operation of said apparatus, and is slidable relative to said film.

18. An apparatus according to claim 17, wherein said heater includes a linear heat generating element extending in a direction crossing with a movement direction of said film.

19. An apparatus according to claim 18, wherein there is no air layer between said heat generating element and the toner image.

20. An image fixing apparatus, comprising:

a heater;

an endless film in contact with said heater on one side and contactable with a recording material on its other side;

a pressing member for urging said recording material to said film and toward said heater;

means for reducing or removing the urging force of said pressing member; and control means for controlling a position of said endless film in a direction perpendicular to a movement direction of said endless film when said pressing member reduces or removes its pressing force.

21. An apparatus according to claim 20, further comprising a displacing mechanism for displacing said pressing member, wherein by displacing said pressing member, the pressure is reduced or removed.

22. An apparatus according to claim 20, further comprising detecting means for detecting a shift of said film.

23. An apparatus according to claim 22, further comprising discriminating means for discriminating whether or not the recording material is in the nip, and prohibiting means for prohibiting operation of said control means when said discriminating means discriminates presence of the recording material in the nip even if said detecting means detects a shift of said film.

24. An apparatus according to claim 22, wherein when said detecting means detects the shift of said film, the pressure is reduced or removed, and thereafter, said control means controls the position of said film, and after termination of operation of said control means, the pressure is automatically reapplied.

25. An apparatus according to claim 20, wherein said control means includes a tension member for applying tension to said film and displacing means for displacing the tension member, wherein the position of said film is controlled by displacing said tension member.

26. An apparatus according to claim 25, wherein said tension member is a follower roller rotatable following said film.

27. An apparatus according to claim 20, further comprising pressing means for pressing said heater, said film and said recording material.

28. An apparatus according to claim 20, wherein said heater is stationary during a fixing operation of said apparatus, and is slidable relative to said film.

29. An apparatus according to claim 28, wherein said heater includes a linear heat generating element extending in a direction crossing with a movement direction of said film.

30. An apparatus according to claim 29, wherein there is no air layer between said heat generating element and the toner image.

31. An apparatus according to claim 20, wherein said control means operates during a period when an image fixing operation of said apparatus is not carried out.

32. An image fixing apparatus, comprising:

a heater;

an endless film through which a toner image on a recording material is heated by heat generated by said heater;

detecting means for detecting a shift of said film;

control means for controlling a position of said endless film in a direction perpendicular to a movement direction of said endless film;

wherein said control means operates when said heater is not energized.

33. An apparatus according to claim 32, wherein said control means operates after energization of said heater is stopped, and in response to detection of a shift of said film by said detecting means, and after operation of said control means, the energization of said heater is resumed.

34. An apparatus according to claim 33, further comprising a pressing member for forming a nip in cooperation with said film for closely contacting said film to the recording material, and means for reducing or removing pressure by said pressing means, wherein the pressure is reduced or removed after the energization of said heater is stopped and before start of operation of said control means, and the pressure is reapplied after completion of operation of said control means and resumption of the energization.

35. An apparatus according to claim 33, wherein said control means includes a tension member for applying tension to said film and displacing means for displacing the tension member, wherein the position of said film is controlled by displacing said tension member.

36. An apparatus according to claim 35, wherein said tension member is a follower roller rotatable following said film.

37. An apparatus according to claim 32, further comprising pressing means for pressing said heater, said film and said recording material.

38. An apparatus according to claim 32, wherein said heater is stationary during a fixing operation of said apparatus, and is slidable relative to said film.

39. An apparatus according to claim 40, wherein said heater includes a linear heat generating element extending in a direction crossing with a movement direction of said film.

40. An apparatus according to claim 39, wherein there is no air layer between said heat generating element and the toner image.

41. An apparatus according to claim 32, wherein said control means operates during a period when an image fixing operation of said apparatus is not carried out.

42. An apparatus according to claim 39, further comprising pressing means for pressing said heater, said film and said recording material.

43. An image fixing apparatus, comprising:

a heater;

a movable film through which a toner image on a recording material is heated by heat generated by said heater;

detecting means for detecting error in a position of said film in a direction perpendicular to a movement direction of said film.

44. An apparatus according to claim 43, further comprising means for controlling the position of said film within a predetermined range, and wherein said error detecting means detects the error when said film is outside the range.

45. An apparatus according to claim 43, wherein said fixing apparatus is used with an image forming apparatus comprising an image forming station for forming the toner image on the recording material, and wherein said image forming apparatus includes error displaying means for displaying occurrence of an error in said film to the operator in response to a signal from said detecting means.

46. An apparatus according to claim 43, wherein said fixing apparatus is used with an image forming apparatus comprising an image forming station for forming the toner image on the recording material, and wherein said image forming apparatus includes interrupting means for interrupting an operation of said image forming means in response to said error detecting means.

47. An apparatus according to claim 46, wherein an error signal is produced by said error detecting means during the image forming operation of said image forming means, said interrupting means continued to a current image forming operation, and disables a next image forming operation.

48. An apparatus according to claim 44, wherein said control means includes a tension member for applying tension to said film and displacing means for displacing the tension member, wherein the position of said film is controlled by displacing said tension member.

49. An apparatus according to claim 48, wherein said tension member is a follower roller rotatable following said film.

50. An apparatus according to claim 43, wherein said heater is stationary during a fixing operation of said apparatus, and is slidable relative to said film.

51. An apparatus according to claim 50, wherein said heater includes a linear heat generating element extending in a direction crossing with a movement direction of said film.

52. An apparatus according to claim 51, wherein there is no air layer between said heat generating element and the toner image.

53. An image fixing apparatus comprising:

a heater;

a movable film through which a toner image on a recording material is heated by heat generated from said heater;

moving means for moving said film in a direction perpendicular to a movement direction of said film and for reciprocating said film within a predetermined range;

wherein a position of contact between said film and an end of the recording material is changed by said moving means.

54. An apparatus according to claim 53, wherein said predetermined range is shiftable.

55. An apparatus according to claim 54, wherein said predetermined range is shifted every predetermined number of fixing operations on the recording material.

56. An apparatus according to claim 54, wherein said predetermined range is shifted every predetermined number of rotations of said film.

57. An apparatus according to claim 53, wherein said moving means moves said film by inclining a follower roller which is rotated by said film and which is effective to apply tension to said film.

58. An apparatus according to claim 53, further comprising pressing means for pressing said heater, said film and said recording material.

59. An apparatus according to claim 53, wherein said heater is stationary during a fixing operation of said apparatus, and is slidable relative to said film.

60. An apparatus according to claim 53, wherein said heater includes a linear heat generating element extending in a direction crossing with a movement direction of said film.

61. An apparatus according to claim 60, wherein there is no air layer between said heat generating element and the toner image.

62. An image fixing apparatus, comprising:

a heater;

a movable film through which a toner image on a recording material is heated by heat generated from said heater;

moving means for moving said film in a direction perpendicular to a movement direction of said film, wherein a position of contact between said film and an end of the recording material is changed by said moving means; and wherein said moving means is operated every predetermined number of fixing operations on the recording materials by said apparatus.

63. An image fixing apparatus, comprising:

a heater;

a movable film through which a toner image on a recording material is heated by heat generated from said heater;

moving means for moving said film in a direction perpendicular to a movement direction of said film wherein a position of contact between said film and an end of the recording material is changed by said moving means; and wherein said moving means is operated every predetermined number of rotations of said film.

64. An image fixing apparatus, comprising:

a heater;

a movable film through which a toner image on a recording material is heated by h®at generated from said heater;

moving means for moving said film in a direction perpendicular to a movement direction of said film wherein a position of contact between said film and an end of the recording material is changed by said moving means; and wherein said moving means is operated upon main switch actuated.

65. An image fixing apparatus, comprising:

a heater;

an endless film through which a toner image on a recording material is heated by heat generated by said heater;

moving means for continuously moving said endless film in a direction perpendicular to a movement direction of said endless film in association with rotation of said film; and reversing means for reversing movement direction of said film by said moving means, wherein when said film rotates said reversing means reverses moving direction of said film by said moving means, so that said film continuously reciprocates in a direction perpendicular to movement direction of said film.

66. An apparatus according to claim 65, wherein said reversing means reverses movement direction by said moving means to maintain position of said film within a predetermined range.

67. An apparatus according to claim 66, further comprising detection means for detecting arrival of said endless film at an end of the predetermined range, wherein said reversing means reverses the movement direction by the moving force in accordance with an output of said detecting means.

68. An apparatus according to claim 65, wherein said moving means moves said film by inclining a follower roller which is rotated by said film and which is effective to apply tension to said film.

69. An apparatus according to claim 65, further comprising pressing means for pressing said heater, said film and said recording material.

70. An apparatus according to claim 65, wherein said heater is stationary during a fixing operation of said apparatus, and is slidable relative to said film.

71. An apparatus according to claim 70, wherein said heater includes a linear heat generating element extending in a direction crossing with a movement direction of said film.

72. An apparatus according to claim 71, wherein there is no air layer between said heat generating element and the toner image.

* * * * *

UNITED STATES PATENT AND TRADEMARK OFFICE

CERTIFICATE OF CORRECTION

PATENT NO. : 5,027,160 Page 1 of 5

DATED : June 25, 1991

INVENTOR(S) : Okada, et al.

It is certified that error appears in the above-identified patent and that said Letters Patent is hereby corrected as shown below:

On title page, item

[30] FOREIGN APPLICATION PRIORITY DATA,
"64-80376" should read --1-80376--.

[57] ABSTRACT,
Line 5, "directon" should read --direction--.

SHEET 10 OF 21,
Figure 15, "DISCHARSE" should read --DISCHARGE--.

SHEET 13 OF 21,
Figure 19, "WRON" should read --WRONG--.

SHEET 16 OF 21,
Figure 23, "SENOR" should read --SENSOR--.

COLUMN 3,
Line 8, "follower roller 26" should read --follower roller 27--;
Line 10, "constitutes" should read --constitute--;
Line 38, "direction." should read --in direction.--; and
Line 40, "in" should be deleted.

COLUMN 4,
Line 56, "original" (first occurrence) should be deleted.

COLUMN 5,
Line 39, "roller 26, the" should read --roller 26. The--.

UNITED STATES PATENT AND TRADEMARK OFFICE

CERTIFICATE OF CORRECTION

PATENT NO. : 5,027,160

DATED : June 25, 1991

INVENTOR(S) : Okada, et al.

It is certified that error appears in the above-identified patent and that said Letters Patent is hereby corrected as shown below:

COLUMN 6,
Line 48, "formed" should read --forms--; and
Line 67, "in" should be deleted.

COLUMN 7,
Line 4, "film 24" should read --film 25--; and
Line 13, "sticks" should read --sticking--.

COLUMN 8,
Line 37, "(Y)," should read --(A),--; and
Line 65, "With" should read --When--.

COLUMN 10,
Line 1, "film" should read --film is--, and "fuorine" should read --fluorine--;
Line 2, "easily" should read --is easily--;
Line 26, "An example" should --Examples--; and
Line 27, "facilimile" should read --facsimile--.

COLUMN 11,
Line 10, "untolerable" should read --intolerable--;
Line 11, "the" should read --and the--; and
Line 40, "are" should read --a--.

UNITED STATES PATENT AND TRADEMARK OFFICE

CERTIFICATE OF CORRECTION

PATENT NO. : 5,027,160

DATED : June 25, 1991

INVENTOR(S) : Okada, et al.

It is certified that error appears in the above-identified patent and that said Letters Patent is hereby corrected as shown below:

COLUMN 12,
Line 33, "a" (1st occurrence) should read --at--
Line 49, "to" should read --to whether--; and
Line 66, "despite" should read --although--.

COLUMN 13,
Line 1, "is set," should be deleted;
Line 9, "despite" should read --although--;
Line 11, "program, similarly." should read --program.--;
Line 20, "is" should read --it is--;
Line 33, "control" should read --controlled--; and
Line 44, "detects" should read --detect--.

COLUMN 14,
Line 30, "to control" should be deleted; and
Line 43, "as" should read --has--.

COLUMN 15,
Line 4, "In the" should read --The--;
Line 20, "chip" should read --check--; and
Line 27, "period T1" should read --period T2--.

COLUMN 16
Line 8, "start," should read --started,-- and
Line 15, "to" should read --to whether--.

COLUMN 17,
Line 52, "displacing" should read --displaced--.

UNITED STATES PATENT AND TRADEMARK OFFICE

CERTIFICATE OF CORRECTION

PATENT NO. : 5,027,160

DATED : June 25, 1991

INVENTOR(S) : Okada, et al.

It is certified that error appears in the above-identified patent and that said Letters Patent is hereby corrected as shown below:

COLUMN 18,
Line 37, "film 25" should read --film 25 to displace--.

COLUMN 19
Line 27, "have" should read --hub--.

COLUMN 20,
Line 5, "belt 24," should read --belt 25,--.

COLUMN 21,
Line 8, "bin 163," should read --pin 163,--;
Line 14, "small" should read --smaller--; and
Line 65, "belt 29" should read --belt 25--.

COLUMN 23,
Line 7, "film;" should read --film; and--.

COLUMN 25,
Line 4, "film;" should read --film; and--;
Line 57, "heater;" should read --heater; and--.

COLUMN 26,
Line 41, "heater;" should read --heater; and--.

UNITED STATES PATENT AND TRADEMARK OFFICE

CERTIFICATE OF CORRECTION

PATENT NO. : 5,027,160

DATED : June 25, 1991

INVENTOR(S) : Okada, et al.

It is certified that error appears in the above-identified patent and that said Letters Patent is hereby corrected as shown below:

COLUMN 27,

Line 10, "heater;" should read --heater; and--;
Line 15, "and" should be deleted;
Line 18, "materials" should read --material--;
Line 23, "heater;" should read --heater; and--;
Line 28, "and" should be deleted;
Line 34, "hRat" should read --heat--;
Line 35, "heater;" should read --heater; and--; and
Line 40, "and" should be deleted.

Signed and Sealed this

Thirtieth Day of March, 1993

*Attest:*

STEPHEN G. KUNIN

*Attesting Officer*

*Acting Commissioner of Patents and Trademarks*